US008274539B2

(12) United States Patent
Ohno

(10) Patent No.: US 8,274,539 B2
(45) Date of Patent: Sep. 25, 2012

(54) LIGHT-EMITTING ELEMENT ARRAY DRIVE DEVICE, PRINT HEAD, IMAGE FORMING APPARATUS AND SIGNAL SUPPLYING METHOD

(75) Inventor: Seiji Ohno, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 493 days.

(21) Appl. No.: 12/551,589

(22) Filed: Sep. 1, 2009

(65) Prior Publication Data

US 2010/0157011 A1 Jun. 24, 2010

(30) Foreign Application Priority Data

Dec. 18, 2008 (JP) ..... 2008-322648

(51) Int. Cl.
*B41J 2/435* (2006.01)

(52) U.S. Cl. ..... 347/237; 347/247

(58) Field of Classification Search ..... 347/237, 347/247

See application file for complete search history.

(56) References Cited

U.S. PATENT DOCUMENTS 7,330,204 B2 * 2/2008 Ohno ..... 347/238
7,954,917 B2 * 6/2011 Inoue ..... 347/9
7,961,209 B2 * 6/2011 Nagumo ..... 347/237

FOREIGN PATENT DOCUMENTS

JP 2003-182143 7/2003
JP 2004-195796 7/2004

* cited by examiner

*Primary Examiner* — Stephen Meier
*Assistant Examiner* — Jeremy Bishop
(74) *Attorney, Agent, or Firm* — Fildes & Outland, P.C.

(57) ABSTRACT

A light-emitting element array drive device includes: plural light-emitting elements; plural switch elements electrically connected mutually in an array and respectively to the light-emitting elements, and setting the respective light-emitting elements ready to emit light when turned on, and unready to emit light when turned off; a transfer signal supply unit supplying transfer signals for getting the switch elements turned-on by sequentially switching each switch element from being turned-off to turned-on, and to turned-off, where periods during which the respective switch elements are turned on are displaced so that each two periods for two of the switch elements adjacently-connected overlap; and a light-emission signal supply unit supplying a light-emission signal having light-emitting periods for the light-emitting elements, where an end point of each light-emitting period is set based on a start point of the above overlap, while a start point thereof is set before each end point.

13 Claims, 12 Drawing Sheets

LIGHT-EMITTING ELEMENT ARRAY DRIVE DEVICE, PRINT HEAD, IMAGE FORMING APPARATUS AND SIGNAL SUPPLYING METHOD

CROSS REFERENCE TO RELATED APPLICATIONS

This application is based on and claims priority under 35 USC §119 from Japanese Patent Application No. 2008-322648 filed Dec. 18, 2008.

BACKGROUND

1. Technical Field

The present invention relates to a light-emitting element array drive device, a print head, an image forming apparatus and a signal supplying method.

2. Related Art

In an electrophotographic image forming apparatus such as a printer, a copier or a facsimile machine, an image is formed on a recording paper sheet as follows. Firstly, an electrostatic latent image is formed on a uniformly charged photoconductor by causing an optical recording unit to emit light so as to transfer image information onto the photoconductor. Then, the electrostatic latent image is made visible by being developed with toner. Lastly, the toner image is transferred on and fixed to the recording paper sheet. In addition to an optical-scanning recording unit that performs exposure by laser scanning in the first scanning direction using a laser beam, a recording device using the following LED print head (LPH) has been employed as such an optical recording unit in recent years in response to demand for downsizing the apparatus. This LPH includes a large number of light emitting diodes (LEDs), serving as light-emitting elements, arrayed in the first scanning direction.

SUMMARY

According to an aspect of the present invention, there is provided a light-emitting element array drive device, including: plural light-emitting elements; plural switch elements that are electrically connected respectively to the plural light-emitting elements and that are electrically connected mutually in an array, each of the switch elements, when turned on, setting one of the light-emitting elements connected thereto ready to emit light, and, when turned off, setting the one of the light-emitting elements connected thereto unready to emit light; a transfer signal supply unit that supplies transfer signals for propagating a turned-on state among the plural switch elements by sequentially switching each of the switch elements from a turned-off state to the turned-on state, and to the turned-off state, the transfer signals having periods during each of which one of the switch elements is turned on, the periods being displaced so that each two of the periods for two of the switch elements adjacently-connected have an overlapping period, the two of the switch elements being both turned on during the overlapping period; and a light-emission signal supply unit that supplies a light-emission signal having light-emitting periods during each of which one of the light-emitting elements is turned on, each of the light-emitting periods having an end point set based on a start point of the overlapping period during which the transfer signals to turn on both of the two of the switch elements adjacently-connected are supplied, having a start point set to a time point before the end point.

BRIEF DESCRIPTION OF THE DRAWINGS

Exemplary embodiment (s) of the present invention will be described in detail based on the following figures, wherein.

DETAILED DESCRIPTION

Hereinafter, a detailed description will be given of a best mode (hereinafter referred to as exemplary embodiment) for carrying out the present invention with reference to the accompanying drawings.

Figure 1:
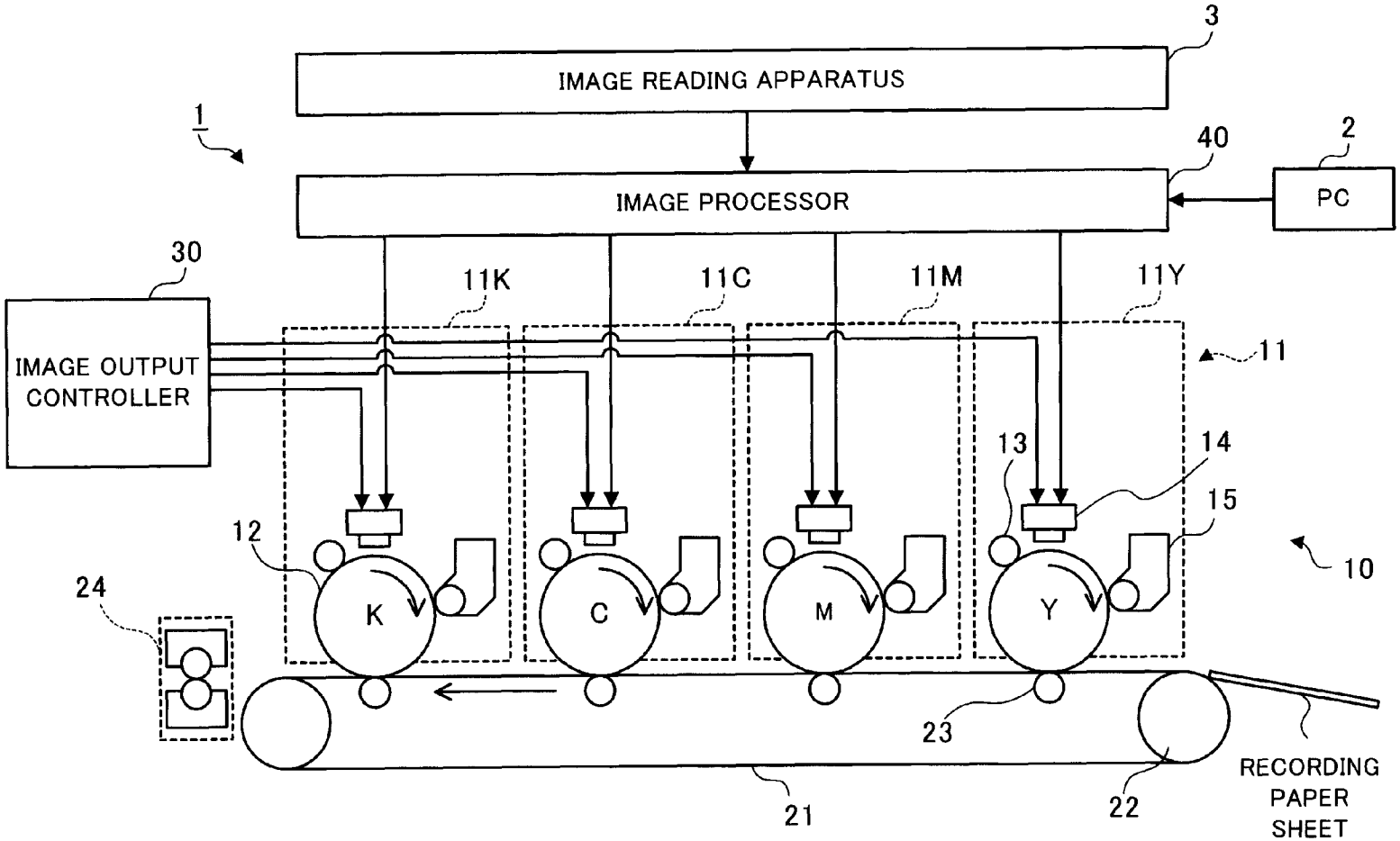
FIG. 1 shows an overall configuration of an image forming apparatus to which the present exemplary embodiment is applied.

FIG. 1 shows an overall configuration of an image forming apparatus 1 to which the present exemplary embodiment is applied. The image forming apparatus 1 shown in FIG. 1 is what is generally termed as a tandem image forming apparatus. The image forming apparatus 1 includes an image forming process unit 10, an image output controller 30 and an image processor 40. The image forming process unit 10 forms an image in accordance with different color image data sets. The image output controller 30 controls the image forming process unit 10. The image processor 40, which is connected to devices such as a personal computer (PC) 2 and an image reading apparatus 3, performs predefined image processing on image data received from the above devices.

The image forming process unit 10 includes image forming units 11. The image forming units 11 are formed of multiple engines placed in parallel at regular intervals. Specifically, the image forming units 11 are formed of four image forming units 11Y, 11M, 11C and 11K. Each of the image forming units 11Y, 11M, 11C and 11K includes a photoconductor drum 12, a charging device 13, a print head 14 and a developing device 15. On the photoconductor drum 12, which is an example of an image carrier, an electrostatic latent image is formed, and the photoconductor drum 12 retains a toner image. The charging device 13, an example of a charging unit, uniformly charges the surface of the photoconductor drum 12 at a predetermined potential. The print head 14 exposes the photoconductor drum 12 charged by the charging device 13. The developing device 15, an example of a developing unit, develops an electrostatic latent image formed by the print head 14. Here, the image forming units 11Y, 11M, 11C and 11K have approximately the same configuration excluding color of toner put in the developing device 15. The image forming units 11Y, 11M, 11C and 11K form yellow (Y), magenta (M), cyan (C) and black (K) toner images, respectively.

In addition, the image forming process unit 10 further includes a sheet transport belt 21, a drive roll 22, transfer rolls 23 and a fixing device 24. The sheet transport belt 21 transports a recording sheet so that different color toner images respectively formed on the photoconductor drums 12 of the image forming units 11Y, 11M, 11C and 11K are transferred on the recording sheet by multilayer transfer. The drive roll 22 drives the sheet transport belt 21. Each transfer roll 23, an example of a transfer unit, transfers a toner image formed on the corresponding photoconductor drum 12 onto the recording sheet. The fixing device 24 fixes the toner images on the recording sheet.

Figure 2:
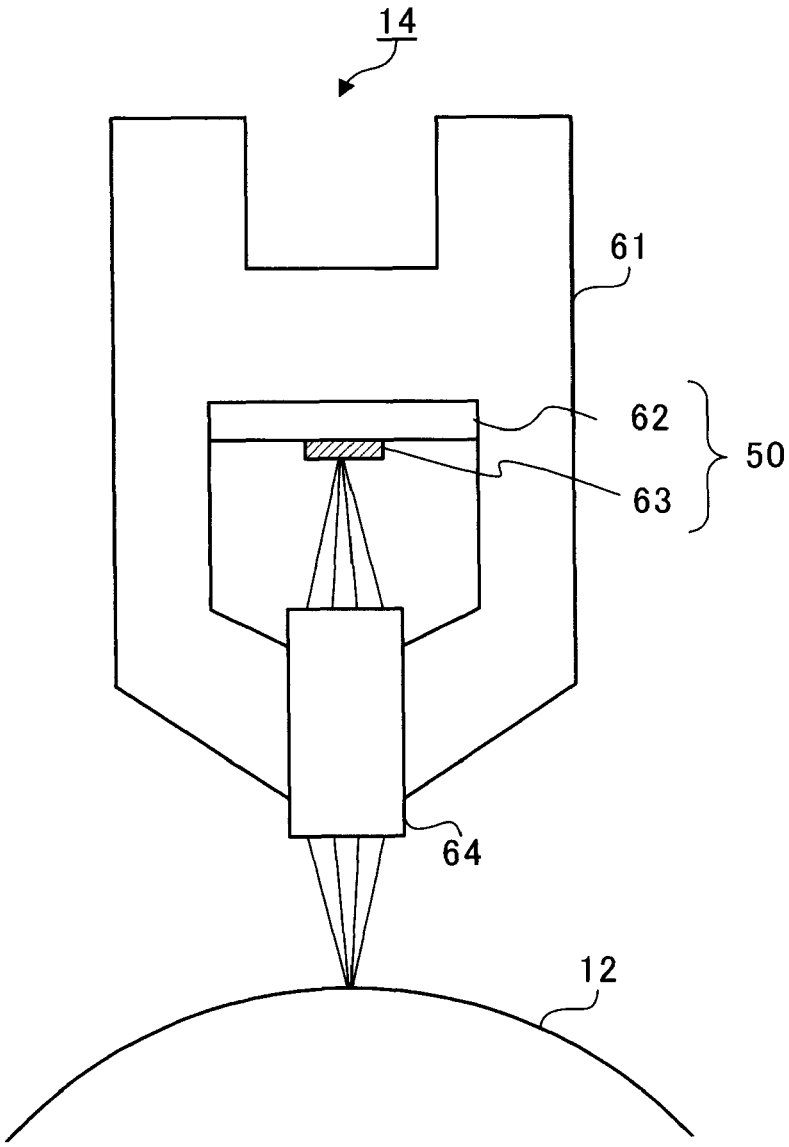
FIG. 2 shows a structure of the print head to which the present exemplary embodiment is applied.

FIG. 2 shows a structure of the print head 14 to which the present exemplary embodiment is applied. The print head 14 includes a housing 61, a self-scanning light-emitting device array (SLED) 63, a circuit board 62 and a rod lens array 64. On the circuit board 62, the SLED 63, a drive circuit 100 (see FIG. 3 to be described later) of the SLED 63, and the like are mounted. The rod lens array 64, an example of an optical unit, focuses light emitted by the SLED 63 onto the surface of the photoconductor drum 12. Hereinbelow, the circuit board 62, the SLED 63, the drive circuit 100 and the like will be collectively referred to as light-emitting element array drive device 50. Note that the light-emitting element array drive device 50 is an example of an exposure unit.

Figure 3:
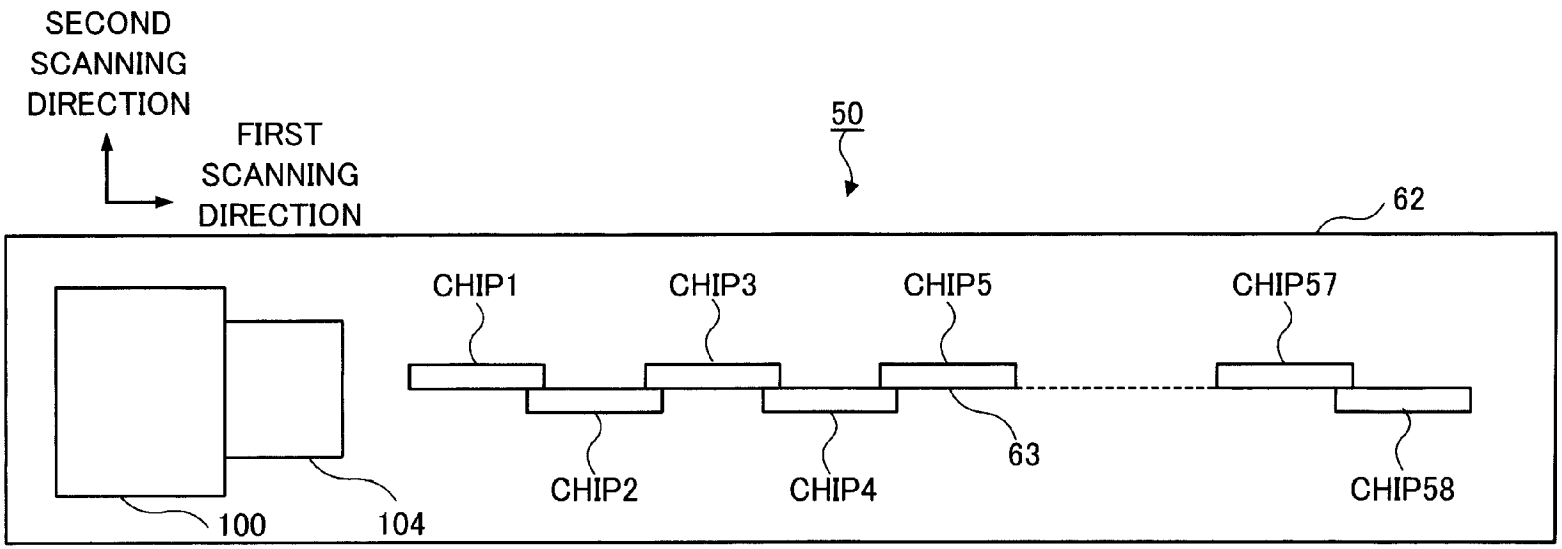
FIG. 3 is a plan view of the light-emitting element array drive device.

FIG. 3 is a plan view of the light-emitting element array drive device 50.

The light-emitting element array drive device 50 includes the circuit board 62, the SLED 63, the drive circuit 100 and a level shift circuit 104. The SLED 63 is formed of, for example, 58 SLED chips (CHIP1 to CHIP58) arrayed on the circuit board 62. Each SLED chip is an example of a light-emitting device, while the level shift circuit 104 is an example of a level shift unit.

Here, the SLED chips (CHIP1 to CHIP58) are arrayed in lines parallel to the axis direction of the photoconductor drum 12 (corresponding to the first scanning direction). In addition, on each of the SLED chips (CHIP1 to CHIP58), 128 light-emitting thyristors (not shown in the figure), for example, are arrayed at equal intervals along a longer side of the rectangular SLED chip. Each light-emitting thyristor is an example of a light-emitting element. The SLED chips are alternately placed in a zigzag pattern so that the light-emitting thyristors are consecutively arrayed in the first scanning direction at a connection between each adjacent two of the SLED chips.

Figure 4:
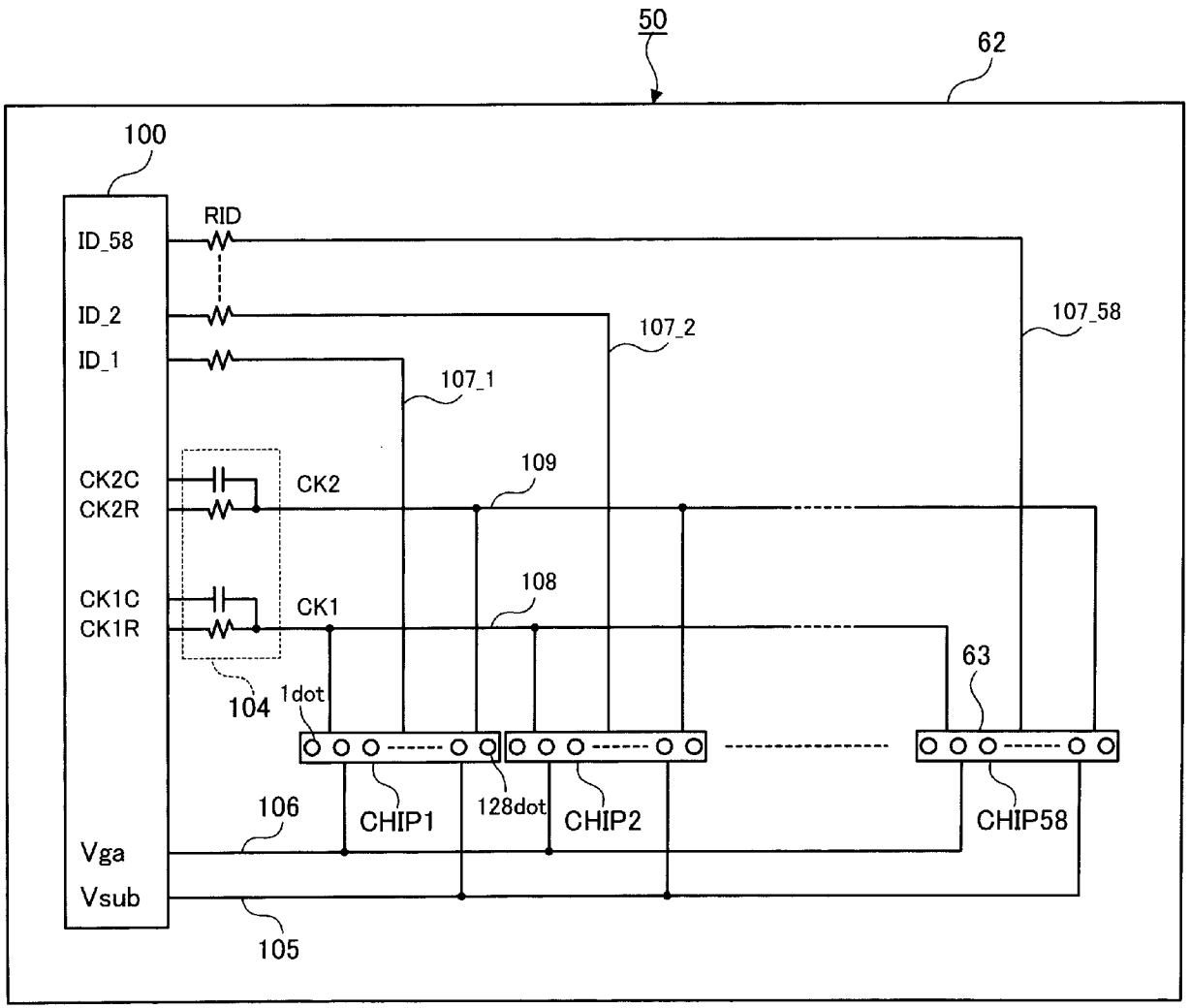
FIG. 4 is a diagram for illustrating a circuit configuration of the light-emitting element array drive device.

FIG. 4 is a diagram for illustrating a circuit configuration of the light-emitting element array drive device 50. The circuit board 62 is provided with power supply lines 105 and 106, signal lines 107 (107_1 to 107_58) and signal lines 108 and 109. Through the power supply line 105, a reference potential Vsub (0 V, for example) is supplied to the SLED chips (CHIP1 to CHIP58). Through the power supply line 106, a power supply voltage Vga (−3.3 V, for example) is supplied to the SLED chips (CHIP1 to CHIP58). Through the signal lines 107, the drive circuit 100, an example of a transfer signal supply unit and a light-emission signal supply unit, transmits light-emission signals ID (ID_1 to ID_58) to the SLED chips, respectively. Through the signal line 108, a transfer signal CK1, which is one of paired transfer signals, is transmitted. Through the signal line 109, a transfer signal CK2, which is the other one of the paired transfer signals, is transmitted.

The light-emission signals ID (ID_1 to ID_58) for the SLED chips (CHIP1 to CHIP58) are inputted to the SLED chips (CHIP1 to CHIP58) through the signal lines 107, respectively. Based on image data outputted by the image processor 40 and luminous amount correction values outputted by the image output controller 30, each of the light-emission signals ID (ID_1 to ID_58) sets up light-emitting periods for the respective light-emitting thyristors on a single light-emitting thyristor basis. Note that the luminous amount correction values are set up for the respective light-emitting thyristors based on their luminous amount values previously measured.

Meanwhile, the transfer signal CK1 is obtained by causing a transfer signal CK1C and a transfer signal CK1R outputted by the drive circuit 100 to pass through the level shift circuit 104, and is inputted in common to the SLED chips (CHIP1 to CHIP58) through the signal line 108. Similarly, the transfer signal CK2 is obtained by causing a transfer signal CK2C and a transfer signal CK2R outputted by the drive circuit 100 to pass through the level shift circuit 104, and is inputted in common to the SLED chips (CHIP1 to CHIP58) through the signal line 109. In other words, the SLED chips (CHIP1 to CHIP58) are driven in common by the pair of the transfer signals CK1 and CK2, and are controlled in parallel.

Next, a description will be given of a detailed circuit configuration of the light-emitting element array drive device 50.

Figure 5:
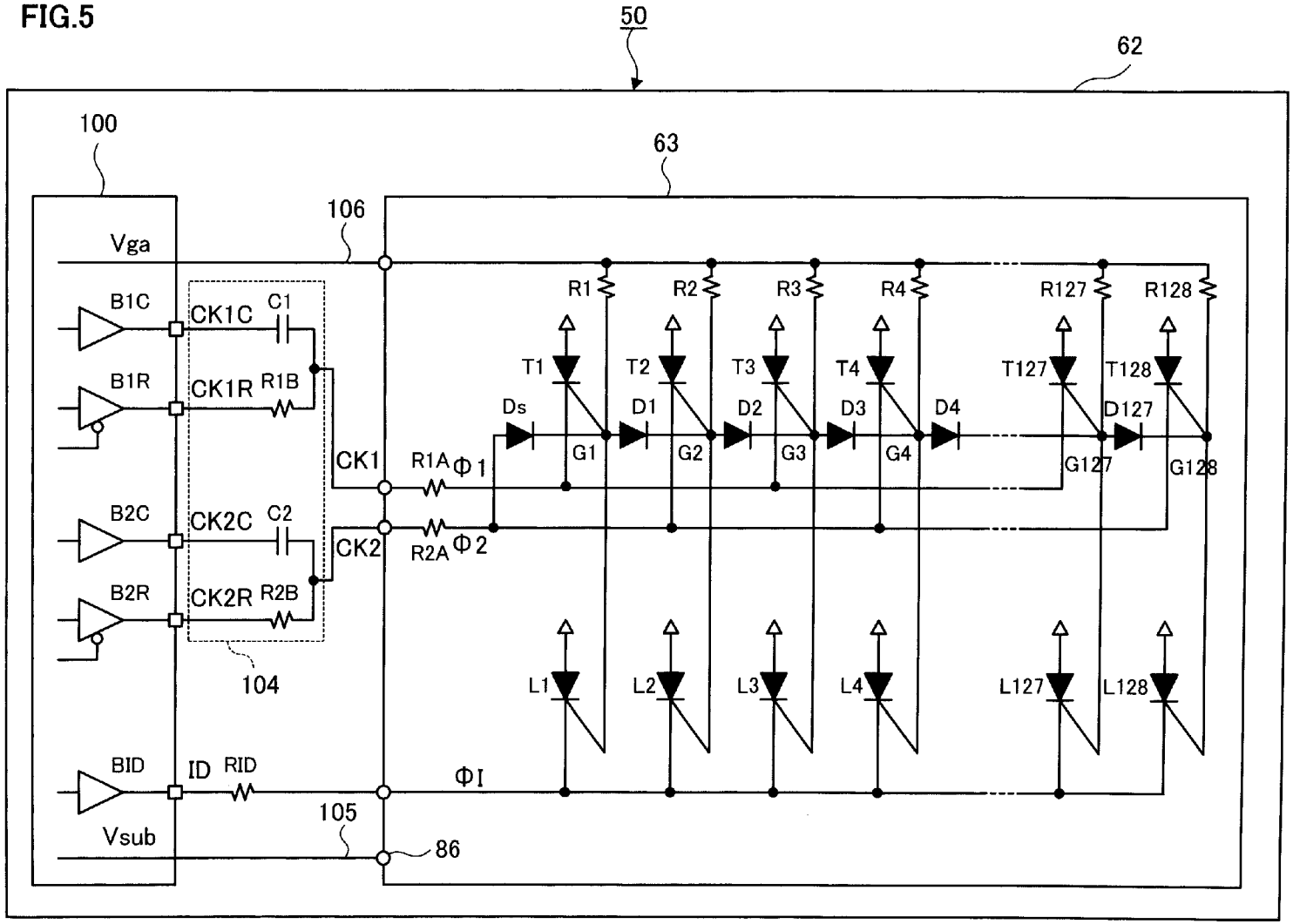
FIG. 5 is a diagram for illustrating the detailed circuit configuration of the light-emitting element array drive device.

FIG. 5 is a diagram for illustrating the detailed circuit configuration of the light-emitting element array drive device 50. Among the 58 SLED chips (CHIP1 to CHIP58) arrayed in the light-emitting element array drive device 50 according to the exemplary embodiment, FIG. 5 shows only one SLED chip. Note that, in the following description, the SLED chip will be referred to as SLED 63 for simplicity.

Firstly, the drive circuit 100 and the level shift circuit 104 will be described.

The drive circuit 100 includes buffers B1C and B2C, and three-state buffers B1R and B2R which respectively supply the transfer signals CK1C, CK1R, CK2C and CK2R. In addition, the drive circuit 100 also includes a buffer BID that supplies the light-emission signal ID. Furthermore, the drive circuit 100 includes a power supply source (not shown in the figure) that supplies a voltage for the transfer signals CK1C, CK1R, CK2C and CK2R, and the light-emission signals ID as well as the power supply voltage Vga and the reference potential Vsub.

Here, a three-state buffer is a buffer capable of setting its output terminal to high impedance (Hiz) in response to a control signal inputted thereto.

The level shift circuit 104 includes a capacitor C1, a resistor R1B, a capacitor C2 and a resistor R2B. The capacitor C1 and the resistor R1B are placed in parallel, and one of the terminals of the capacitor C1 is connected to one of the terminals of the resistor R1B. These mutually-connected terminals of the capacitor C1 and the resistor R1B are further connected to an input terminal of the SLED 63. Similarly, the capacitor C2 and the resistor R2B are placed in parallel, and one of the terminals of the capacitor C2 is connected to one of the terminals of the resistor R2B. These mutually-connected terminals of the capacitor C2 and the resistor R2B are further connected to an input terminal of the SLED 63.

Meanwhile, the other terminal, which is not connected to the resistor R1B, of the capacitor C1 is connected to an output terminal of the buffer B1C via an output terminal of the drive circuit 100. The other terminal, which is not connected to the capacitor C1, of the resistor R1B is connected to an output terminal of the three-state buffer B1R via an output terminal of the drive circuit 100.

Similarly, the other terminal, which is not connected to the resistor R2B, of the capacitor C2 is connected to an output terminal of the buffer B2C via an output terminal of the drive circuit 100. The other terminal, which is not connected to the capacitor C2, of the resistor R2B is connected to an output terminal of the three-state buffer B2R via an output terminal of the drive circuit 100.

The drive circuit 100 outputs the transfer signals CK1C and CK1R from the output terminals of the buffer B1C and the three-state buffer B1R, respectively. Based on the signals, the level shift circuit 104 generates the transfer signal CK1 and supplies it to the SLED 63. Similarly, the drive circuit 100 outputs the transfer signals CK2C and CK2R from the output terminals of the buffer B2C and the three-state buffer B2R, respectively. Based on the signals, the level shift circuit 104 generates the transfer signal CK2 and supplies it to the SLED 63.

In addition, the drive circuit 100 outputs the light-emission signal ID from an output terminal of the buffer BID, and supplies it to the SLED 63 via a resistor RID.

Next, the SLED 63 will be described.

As shown in FIG. 5, the SLED 63 includes 128 transfer thyristors T1 to T128, 128 light-emitting thyristors L1 to L128, 127 diodes D1 to D127, a start diode Ds, 128 resistors R1 to R128, and transfer current limiting resistors R1A and R2A, for example. Each of the transfer thyristors T1 to T128 is an example of a switch element, while each of the light-emitting thyristors L1 to L128 is an example of a light-emitting element. The transfer current limiting resistors R1A and R2A prevent excessive currents from flowing through signal lines Φ1 and Φ2, respectively.

The transfer thyristors T1 to T128 are arrayed in a line in numerical order, and the light-emitting thyristors L1 to L128 are also arrayed in a line in numerical order.

In the SLED 63 according to the present exemplary embodiment, anode terminals of the respective transfer thyristors T1 to T128 and the respective light-emitting thyristors L1 to L128 are connected to the power supply line 105 via a backside common electrode terminal 86. The reference potential Vsub (0 V) is supplied to the power supply line 105.

Cathode terminals of the respective odd-numbered transfer thyristors T1, T3, . . . , T127 are connected to the signal line Φ1. The transfer signal CK1 is supplied to the signal line Φ1 via the transfer current limiting resistor R1A.

Meanwhile, cathode terminals of the respective even-numbered thyristors T2, T4, . . . , T128 are connected to the signal line Φ2. The transfer signal CK2 is supplied to the signal line Φ2 via the transfer current limiting resistor R2A.

On the other hand, gate terminals G1 to G128 of the transfer thyristors T1 to T128 are connected to the power supply line 106 via the resistors R1 to R128 provided corresponding to the transfer thyristors T1 to T128, respectively. The power supply voltage Vga (−3.3 V) is supplied to the power supply line 106.

In addition, the gate terminals G1 to G128 of the transfer thyristors T1 to T128 are connected to gate terminals of the light-emitting thyristors L1 to L128, respectively. Accordingly, the gate terminals of the light-emitting thyristors L1 to L128 will not hereinafter be distinguished from the gate terminals G1 to G128 of the transfer thyristors T1 to T128, and thus will be also referred to as gate terminals G1 to G128, respectively.

The gate terminals G1 to G127 of the transfer thyristors T1 to T127 are connected to anode terminals of the diodes D1 to D127, respectively. The gate terminals G2 to G128 of the transfer thyristors T2 to T128 are connected to cathode terminals of the diodes D1 to D127. In other words, the diodes D1 to D127 are connected in series with one of the diodes D1 to D127 interposed between each adjacent two of the gate terminals G1 to G128.

In addition, the gate terminal G1 of the transfer thyristor T1 is connected to a cathode terminal of the start diode Ds. Meanwhile, an anode terminal of the start diode Ds is connected to the signal line Φ2. Thus the anode terminal of the start diode Ds is supplied with the transfer signal CK2 via the transfer current limiting resistor R2A.

Cathode terminals of the light-emitting thyristors L1 to L128 are connected to a light-emission signal line ΦI, which is supplied with the light-emission signal ID via the resistor RID.

Figure 6:
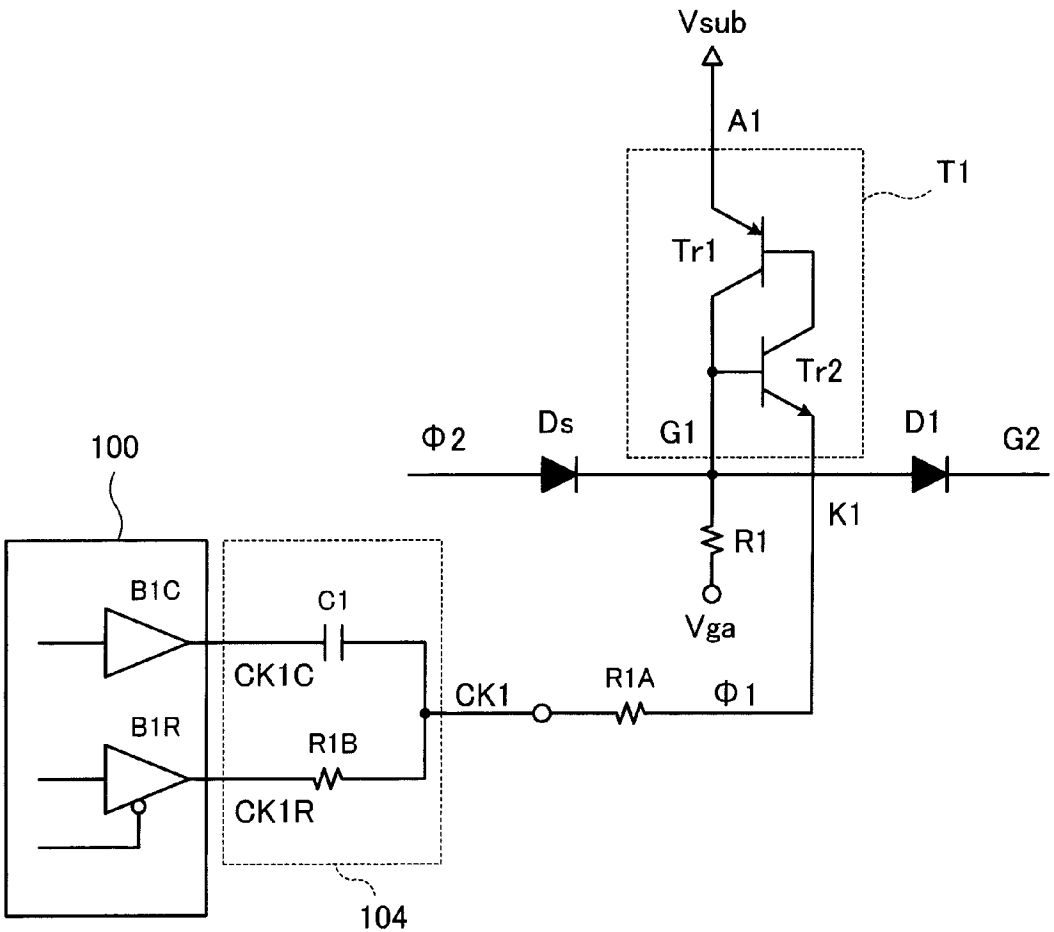
FIG. 6 shows the transfer thyristor, and a portion for supplying the transfer signal in the drive circuit and the level shift circuit.

FIG. 6 shows the transfer thyristor T1, and a portion for supplying the transfer signal CK1 in the drive circuit 100 and the level shift circuit 104 in FIG. 5. In FIG. 6, the transfer thyristor T1 is shown as an equivalent circuit using a pnp transistor Tr1 and an npn transistor Tr2. An emitter terminal of the pnp transistor Tr1, which serves as the anode terminal A1 of the transfer thyristor T1, is connected to reference potential Vsub. A collector terminal of the pnp transistor Tr1 serves as the gate terminal G1 of the transfer thyristor T1. Meanwhile, an emitter terminal of the npn transistor Tr2, which serves as the cathode terminal K1 of the transfer thyristor T1, is connected to the signal line Φ1. A base terminal of the npn transistor Tr2, which serves as the gate terminal G1 of the transfer thyristor T1, is connected to the collector terminal of the pnp transistor Tr1. In addition, a base terminal of the pnp transistor Tr1 is connected to a collector terminal of the npn transistor Tr2.

The drive circuit 100 and the level shift circuit 104 have been already described above, and thus the description thereof is omitted here.

Figure 7B:
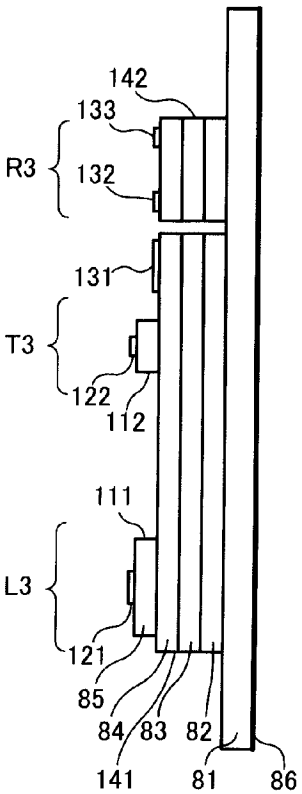
FIGS. 7A and 7B show a planar layout of the SLED and a cross-sectional view.
Figure 7A:
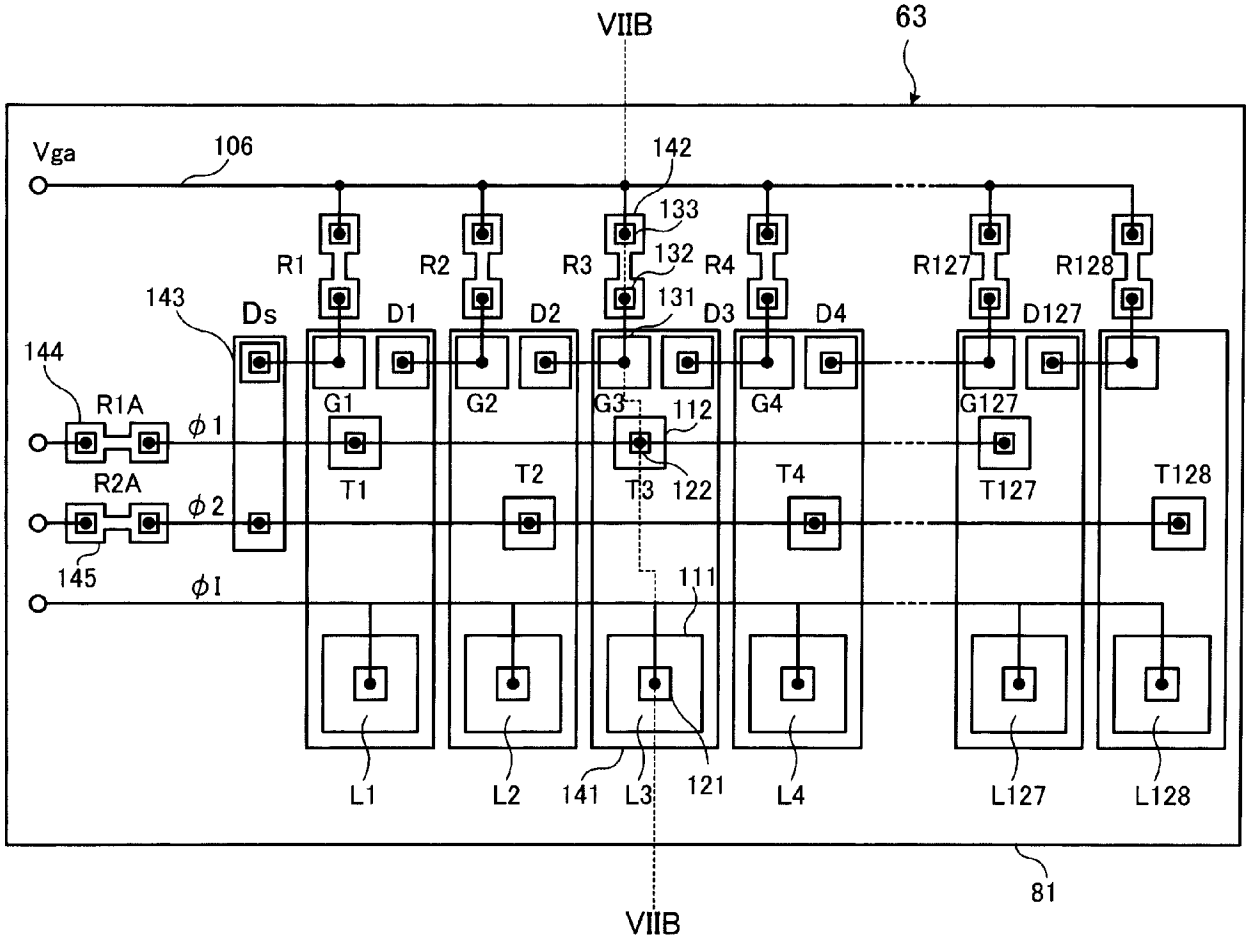

FIG. 7A shows a planar layout of the SLED 63. FIG. 7B is a cross-sectional view taken along the VIIB-VIIB line shown in FIG. 7A. In other words, FIG. 7B shows cross sections of the light-emitting thyristor L3, the transfer thyristor T3 and the resistor R3.

As shown in FIG. 7A, the SLED 63 includes a substrate 81, first islands 141, second islands 142, a third island 143, a fourth island 144 and a fifth island 145. In each of the first islands 141, one of the light-emitting thyristors L1 to L128, the corresponding one of the transfer thyristors T1 to T128, and the corresponding one of the diodes D1 to D127 are formed (The light-emitting thyristor L3, the transfer thyristor T3 and the diode D3 are formed in one of the first islands 141, for example). In each of the second islands 142, one of the resistors R1 to R128 is formed (The resistor R3 is formed in one of the second islands 142, for example). In the third island 143, the start diode Ds is formed. In the fourth and fifth islands 144 and 145, the transfer current limiting resistors R1A and R2A are formed, respectively.

As shown in FIG. 7B, the SLED 63 has a pnpn structure in which a p-type first semiconductor layer 82, an n-type second semiconductor layer 83, a p-type third semiconductor layer 84 and an n-type fourth semiconductor layer 85 are stacked on the substrate 81 in this order.

The backside common electrode terminal 86 is formed on the back surface of the substrate 81.

In one of the first islands 141, the light-emitting thyristor L3 is formed. The light-emitting thyristor L3 uses the backside common electrode terminal 86, an ohmic electrode 121 and an ohmic electrode 131 as the anode terminal, the cathode terminal and the gate terminal G3, respectively. Here, the ohmic electrode 121 is formed on a region 111 of the n-type fourth semiconductor layer 85, while the ohmic electrode 131 is formed on the p-type third semiconductor layer 84 after etch removal of the n-type fourth semiconductor layer 85.

In addition, the transfer thyristor T3 is also formed in the first island 141. The transfer thyristor T3 uses the backside common electrode terminal 86, an ohmic electrode 122 and the ohmic electrode 131 as the anode terminal, the cathode terminal and the gate terminal G3, respectively. Here, the ohmic electrode 122 is formed on a region 112 of the n-type fourth semiconductor layer 85, while the ohmic electrode 131 is formed on the p-type third semiconductor layer 84.

The ohmic electrode 131 serves as the gate terminal G3, which is common to the light-emitting thyristor L3 and the transfer thyristor T3.

In addition, although not shown in FIG. 7B, the diode D3 is also formed in the first island 141. The diode D3 uses the p-type third semiconductor layer 84 and the n-type fourth semiconductor layer 85 as the anode terminal and the cathode terminal, respectively.

In other words, the light-emitting thyristor L3, the transfer thyristor T3 and the diode D3 are formed in the first island 141.

In one of the second islands 142, the resistor R3 is formed between an ohmic electrode 132 and an ohmic electrode 133 that are formed on the p-type third semiconductor layer 84. In other words, the resistors R1 to R128 are formed using the p-type third semiconductor layer 84.

In the third island 143, the start diode Ds is formed. Like the diode D3, the start diode Ds uses the p-type third semiconductor layer 84 and the n-type fourth semiconductor layer 85 as the anode terminal and the cathode terminal, respectively.

In the fourth and fifth islands 144 and 145, the transfer current limiting resistors R1A and R2A are formed, respectively. These resistors are formed using the p-type third semiconductor layer 84, like the resistor R3.

Hereinbelow, a description will be given of a connection relation regarding the first islands 141 and the second islands 142 shown in FIG. 7A.

The ohmic electrode 131, which serves as the gate terminal G3 common to the transfer thyristor T3 and the light-emitting thyristor L3, is connected to the ohmic electrode 132 of the resistor R3. In addition, the ohmic electrode 131 is also connected to the cathode terminal of the diode D2, which is formed in an adjacent one of the first islands 141. The ohmic electrode 121 of the light-emitting thyristor L3 is connected to the light-emission signal line ΦI. The ohmic electrode 122 of the odd-numbered transfer thyristor T3 is connected to the signal line Φ1. The signal line Φ1 is connected to the input terminal of the SLED 63 via the transfer current limiting resistor R1A.

Note that the cathode terminal of each of the even-numbered transfer thyristors T2, T4, . . . , T128 is connected to the signal line Φ2. The signal lines Φ2 is connected to the input terminal of the SLED 63 via the transfer current limiting resistor R2A.

In addition, the ohmic electrode 133 of each second island 142 is connected to the power supply line 106.

The same holds true for the other light-emitting thyristors, the other transfer thyristors and the other diodes, and thus the description thereof is omitted here.

Next, a description will be given of the signals for driving the SLED 63 (drive signals) outputted by the drive circuit 100 and the level shift circuit 104, as well as of the potentials of the signal lines Φ1 and Φ2, and the light-emission signal line ΦI in the SLED 63.

Figure 8:
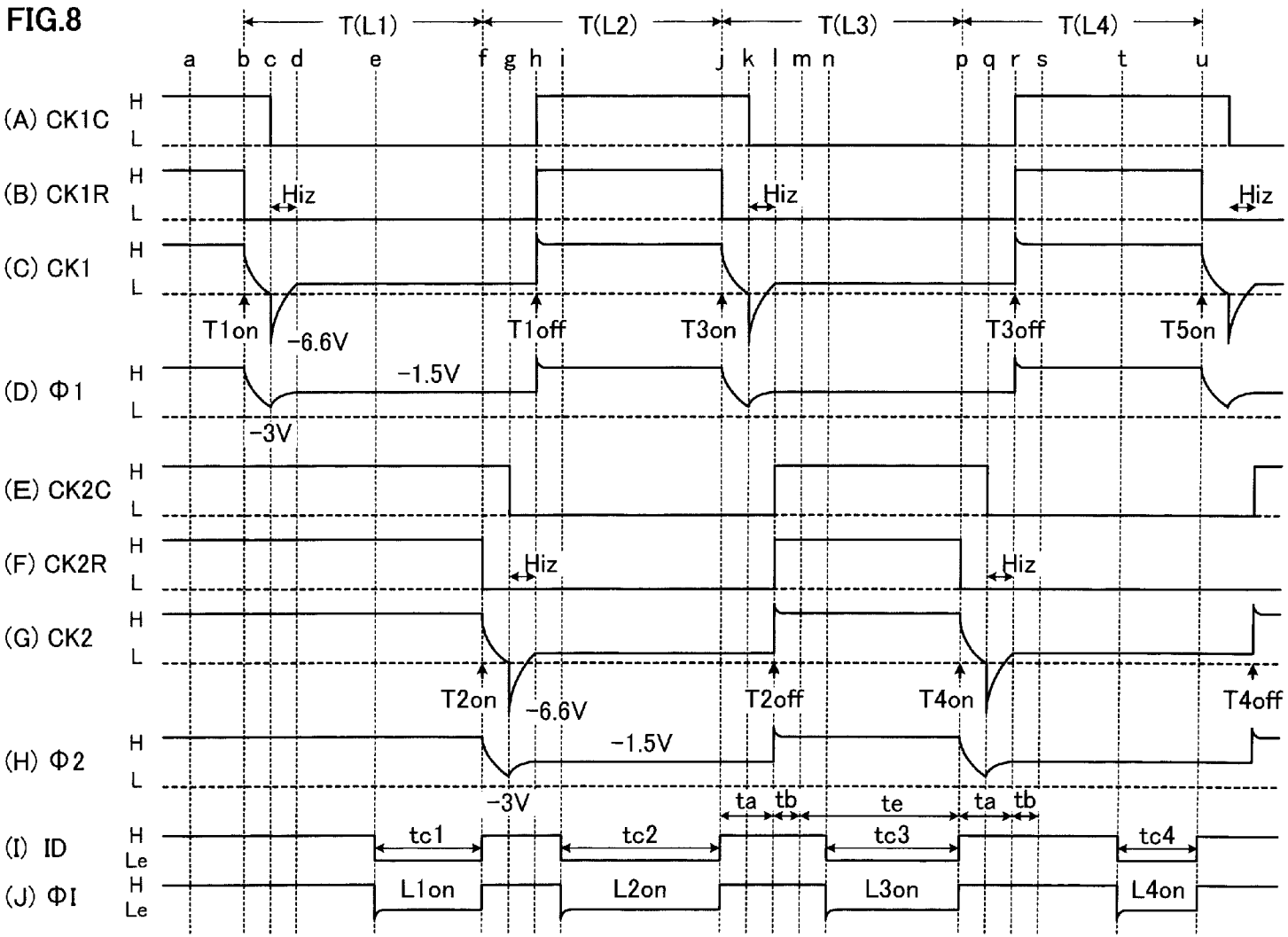
FIG. 8 is a timing chart showing the drive signals outputted by the drive circuit and the level shift circuit, and the potentials of the signal lines and the like in the SLED.

FIG. 8 is a timing chart showing the drive signals outputted by the drive circuit 100 and the level shift circuit 104, and the potentials of the signal lines Φ1 and Φ2, and the light-emission signal line ΦI in the SLED 63. Assume here that time flows from a time point a to a time point u in alphabetical order.

In the SLED 63, the transfer thyristors are turned on in ascending numerical order one by one, and the light-emitting thyristor provided corresponding to the transfer thyristor that is currently turned on is set ready to emit light. Based on the light-emission signal ID, the light-emitting thyristor that is currently set ready to emit light is controlled so as to emit light or not, as well as the length of the light-emitting period thereof is controlled.

FIG. 8 focuses on light-emission control on the light-emitting thyristors L1 to L4 in the SLED 63 in which all these light-emitting thyristors L1 to L4 are caused to "emit light."

Each of periods T in FIG. 8 indicates a period during which one of the light-emitting thyristors is controlled so as to emit light or not. Specifically, during a period T(L1) from a time point b to a time point f, the light-emitting thyristor L1 is controlled. During a period T(L2) from the time point f to a time point j, the light-emitting thyristor L2 is controlled. During a period T(L3) from the time point j to a time point p, the light-emitting thyristor L3 is controlled. During a period T(L4) from the time point p to the time point u, the light-emitting thyristor L4 is controlled.

Hereinafter, the timing chart of FIG. 8 will be described with reference to FIG. 5.

In FIG. 8, the transfer signal CK1C ((A) in FIG. 8) is outputted by the buffer B1C, and supplied to the capacitor C1 of the level shift circuit 104. Meanwhile, the transfer signal CK1R ((B) in FIG. 8) is outputted by the three-state buffer B1R, and supplied to the resistor R1B of the level shift circuit 104.

The transfer signal CK1 ((C) in FIG. 8) is a potential at the connection between the capacitor C1 and the resistor R1B in the level shift circuit 104. Φ1 ((D) in FIG. 8) denotes a potential of the signal line Φ1 at a portion in the SLED 63 that is farther from the input terminal than the transfer current limiting resistor R1A of the SLED 63 is.

Similarly, the transfer signal CK2C ((E) in FIG. 8) is outputted by the buffer B2C, and supplied to the capacitor C2 of the level shift circuit 104. Meanwhile, the transfer signal CK2R ((F) in FIG. 8) is outputted by the three-state buffer B2R, and supplied to the resistor R2B of the level shift circuit 104.

The transfer signal CK2 ((G) in FIG. 8) is a potential at the connection between the capacitor C2 and the resistor R2B in the level shift circuit 104. Φ2 ((H) in FIG. 8) denotes a potential of the signal line Φ2 at a portion in the SLED 63 that is farther from the input terminal than the transfer current limiting resistor R2A of the SLED 63 is.

In addition, the light-emission signal ID ((I) in FIG. 8) causes the light-emitting thyristors L1 to L128 to emit light or not, and sets the light-emitting periods therefor, as described above. ΦI ((J) in FIG. 8) denotes a potential of the light-emission signal line ΦI in the SLED 63.

As described above, the transfer signals CK1C, CK1R, CK2C and CK2R, and the light-emission signals ID are supplied by the drive circuit 100. Meanwhile, the transfer signal CK1 is generated from the transfer signals CK1C and CK1R, while the transfer signal CK2 is generated from the transfer signals CK2C and CK2R. Φ1, Φ2 and ΦI denote the potential in the SLED 63.

The period T(L1) in FIG. 8 is not only a light-emission control period for the light-emitting thyristor L1, but also a period in which the drive of the SLED 63 starts. Thus, the signals have different waveforms in the period T(L1) from those in the subsequent periods T in that, for example, the transfer signals CK2C and CK2R are not applied during the period T(L1). Hence, the signals will hereinafter be outlined by using the signal waveforms in the periods T(L3) and T(L4), which are repeated in the subsequent periods T.

Each of the transfer signals CK1C, CK1R, CK2C and CK2R repeats a cycle of total period (2×T) of the periods T (L3) and T (L4). Thus a description will be given by using the total period of the periods T (L3) and T (L4) (from the time point j to the time point u) as a unit period.

The transfer signal CK1C changes from a high level (hereinafter, referred to as "H") to a low level (hereinafter, referred to as "L") at a time point k, and then changes from "L" to "H" at a time point r. During the other parts of the unit period, the transfer signal CK1C is set to "H."

The transfer signal CK1R changes from "H" to "L" at the time point j, and then changes from "L" to "H" at the time point r. During the other parts of the unit period, the transfer signal CK1R is set to "H."

The transfer signal CK2C changes from "L" to "H" at a time point l, and then changes from "H" to "L" at a time point q. During the other parts of the unit period, the transfer signal CK2C is set to "L."

The transfer signal CK2R changes from "L" to "H" at the time point l, and then changes from "H" to "L" at the time point p. During the other parts of the unit period, the transfer signal CK2R is set to "L."

Here, comparison between the transfer signals CK1C and CK2C shows that the transfer signal CK2C is obtained by shifting the transfer signal CK1C along the time axis to the right in FIG. 8 by a length of the period T. Similarly, the transfer signal CK2R is obtained by shifting the transfer signal CK1R along the time axis to the right in FIG. 8 by the length of the period T.

Meanwhile, the light-emission signal ID changes from "H" to a low level of the light-emission signal ID (hereinafter, referred to as "Le") at a time point n, and then changes from "Le" to "H" at the time point p. During the other part of the period T(L3), the light-emission signal ID is set to "H." Note that "Le" denotes a light-emission potential that may cause the light-emitting thyristor to emit light. The potential of "Le" is different from the potential of "L," and will be described later.

While the light-emission signal ID is set to "Le," the potential of the light-emission signal line ΦI is also set to "Le." The light-emitting thyristor L3 keeps emitting light (L3on) in the period during which the light-emission signal ID is set to "Le." The period during which the light-emission signal ID is set to "Le" will hereinafter be referred to as light-emitting period tc.

Note that light-emitting periods tc are different in length among each of the light-emitting thyristors in accordance with the luminous amount correction values therefor. Accordingly, the light-emitting periods tc for the light-emitting thyristors L1 to L4 will hereinafter be referred to as light-emitting periods tc1 to tc4, respectively, so as to be distinguished from one another. In FIG. 8 as well, the light-emitting periods tc1 to tc4 in the respective periods T(L1) to T(L4) are different in length.

Each light-emitting period tc needs to be set within a light-emission ready period te. Assume here that a period ta is a period during which the transfer signals CK1R and CK2R are both set to "L," and a period tb is a predetermined period from when the transfer signal CK1R or CK2R changes to "H." Then, the light-emission ready period te is a period from when the periods ta and tb in the period T(L3) have elapsed to when the period ta in period T(L4) starts. The periods ta, tb and te will be described later.

In the exemplary embodiment, as indicated by (I) ID in FIG. 8, the end point of the light-emitting period is set to the start point of the period ta. Meanwhile, the start point of the light-emitting period is set to the time point the light-emitting period tc before the start point of the period ta. In the period T(L3), for example, the time point when the light-emitting thyristor L3 starts emitting light is set to the time point n the light-emitting period tc3 before the time point p. Here, the time point p is the start point of the period ta in the period T(L4).

Accordingly, in the light-emitting element array drive device 50, the time points when the light-emitting thyristors in the respective SLED chips driven in parallel start emitting light will be different from one another in accordance with the respective luminous amount correction values therefor.

This configuration eliminates the need for the drive circuit 100 to supply a current large enough to cause all the target light-emitting thyristors to emit light at a time. Instead, the drive circuit 100 needs only to supply a current for causing the target light-emitting thyristors to emit light at different time points preset for the respective light-emitting thyristors to start emitting light, as well as a current for maintaining the light-emitting state of the light-emitting thyristors that are emitting light. Accordingly, the configuration makes the power supply source provided in the drive circuit 100 have smaller current supply capability, and thus reduce the drive circuit 100 in size. Furthermore, the light-emitting element array drive device 50 may also be reduced in size by using the drive circuit 100 therein.

In addition, this further reduces increase in heat generation and light leakage from the SLED chips.

Note that in the above description, the end point of the light-emitting period tc is set at the start point of the period ta. However, the end point of the light-emitting period to may be set a predetermined period before the start point of the period ta. Moreover, the end point of the light-emitting period tc may be set a predetermined period after the start point of the period ta. These will be described later.

Next, the operations of the SLED 63 will be described. Before the description, the conditions for turning on a thyristor such as a transfer thyristor will be described, with reference to the equivalent circuit of the transfer thyristor T1 shown in FIG. 6.

To turn on the transfer thyristor T1, the two transistors constituting the equivalent circuit of the transfer thyristor T1, namely, the pnp transistor Tr1 and the npn transistor Tr2, need to be both turned on.

Note that, the description that a thyristor is turned on specifically refers to a state where each of the pnp transistor Tr1 and the npn transistor Tr2 that have been both turned off changes to on, and thus the thyristor becomes conductive (has a low resistance) between the anode terminal and the cathode terminal. On the other hand, the description that a thyristor is turned off specifically refers to a state where each of the pnp transistor Tr1 and the npn transistor Tr2 that have been both turned on changes to off, and thus the thyristor becomes nonconductive (has a high resistance) between the anode terminal and the cathode terminal.

Here, the base terminal and the emitter terminal of the npn transistor Tr2 serve as the gate terminal G1 and the cathode terminal K1 of the transfer thyristor T1, respectively.

To turn on the npn transistor Tr2, the npn transistor Tr2 needs to be forward biased between the base terminal (G1) and the emitter terminal (K1). This requires the potential difference between the base terminal (G1) and the emitter terminal (K1) to be larger than a forward threshold voltage (diffusion potential) Vd of a pn junction. In other words, the potential difference between the base terminal (G1) and the emitter terminal (K1) needs to be larger than 1.5 V since Vd is considered to be 1.5 V based on the properties of the SLED chip.

When the potential difference between the base terminal (G1) and the emitter terminal (K1) exceeds 1.5 V, a current starts flowing between the base terminal (G1) and the emitter terminal (K1), and thus the npn transistor Tr2 gets turned on. This further causes a current to start flowing between the collector terminal and the emitter terminal (K1) of the npn transistor Tr2. In response, a current starts flowing between the base terminal and the emitter terminal (A1) of the pnp transistor Tr1, and thus the pnp transistor Tr1 gets turned on. In this way, the pnp transistor Tr1 and the npn transistor Tr2 are both turned on, and thus the transfer thyristor T1 gets turned on.

Then, the potential of the cathode terminal K1 of the transfer thyristor T1 becomes −1.5 V of −Vd, while the potential of the gate terminal G1 becomes approximately 0 V ("H").

As described above, the conditions for turning on a transfer thyristor are: to forward bias the transfer thyristor between the gate terminal and the cathode terminal; and to increase the potential difference therebetween to more than 1.5 V. That is, in general, conditions for turning on a thyristor are: to forward bias the thyristor between the gate terminal and the cathode terminal; and to increase the potential difference therebetween to more than Vd.

Here, the cathode terminal of each transfer thyristor is connected to the signal line Φ1 or Φ2. Thus, the conditions for turning on a transfer thyristor may alternatively be described as: to set the potential difference between the gate terminal and the signal line Φ1 (or Φ2) so as to forward bias the transfer thyristor between the gate terminal and the cathode terminal; and to increase the potential difference therebetween to more than 1.5 V.

Then, with reference to FIGS. 5, 6 and 8, the operations of the SLED 63 will be described in order of time based on the time points (the time points a, b, c, . . . ) shown in FIG. 8.

(1) Firstly, in the initial state (at the time point a), the transfer signal CK1 is set to "H" (0 V) by setting both the transfer signals CK1C and CK1R to "H." Similarly, the transfer signal CK2 is also set to "H" by setting both the transfer signals CK2C and CK2R to "H."

Here, the transfer signal CK1 is supplied to the signal line Φ1 via the transfer current limiting resistor R1A, and thus the potential of the signal line Φ1 is also "H." Similarly, the transfer signal CK2 is supplied to the signal line Φ2 via the transfer current limiting resistor R2A, and thus the potential of the signal line Φ2 is also "H."

In addition, the light-emission signal ID is set to "H," and thus the potential of the light-emission signal line ΦI is also "H."

In that initial state, the start diode Ds is forward biased since the anode terminal and the cathode terminal thereof are set respectively to "H" (0 V), which is the potential of the signal line Φ2, and to "L" (−3.3 V), which is the power supply voltage Vga. Accordingly, the potential of the gate terminal G1 of the transfer thyristor T1 is −1.5 V, a value obtained by subtracting the forward threshold voltage (diffusion potential) Vd of the pn junction of the start diode Ds from the potential "H" (0 V) of the signal line Φ2.

However, the transfer thyristors T1 to T128 and the light-emitting thyristors L1 to L128 are all turned off since the cathode terminal and the anode terminal of each of these thyristors have the same potential, that is, "H" (0 V).

(2) At the time point b, the transfer signal CK1R is set to "L" (−3.3 V), and thus the operation of the SLED 63 starts.

When the transfer signal CK1R is set to "L," the transfer signal CK1 changes from "H" to "L." In response, a voltage is generated between the terminals of the capacitor C1, and the potential of the signal line Φ1 changes from "H" to "L." When the potential of the signal line Φ1 becomes lower than the total value (−3 V) of the potential of the gate terminal G1 (−1.5 V) and the forward threshold voltage (diffusion potential) Vd of the pn junction, the potential difference between the gate terminal G1 of the transfer thyristor T1 and the signal line Φ1 exceeds 1.5 V. This causes a gate current of the transfer thyristor T1 to start flowing as described above, and thus the transfer thyristor T1 starts being turned on.

However, the potential difference between the transfer signal CK1 and the signal line Φ1 (−3 V) is only 0.3 V since the minimum reachable potential of the transfer signal CK1 is −3.3 V. Such a small potential difference is incapable of supplying a sufficient current to the transfer thyristor T1, and thus it takes too long to turn on the transfer thyristor T1 with the potential difference.

(3) To avoid this, the transfer signal CK1C is set to "L" at a time point c.

In response to this sharp potential drop to "L" (−3.3 V) of the transfer signal CK1C, the potential of the transfer signal CK1 sharply drops to −6.6 V. This increases the gate current of the transfer thyristor T1, and thus accelerates the pace for turning on the transfer thyristor T1.

Note that the three-state buffer B1R is set to high impedance (Hiz) when the transfer signal CK1C is set to "L." This prevents a current from flowing in the level shift circuit 104 through the three-state buffer B1R, and thus prevents the potential of the transfer signal CK1 from changing to "L."

After that, the potential of the signal line Φ1 rises as the gate current of the transfer thyristor T1 increases. In addition, the potential of the transfer signal CK1 gradually rises as a current flows in the capacitor C1 of the level shift circuit 104.

(4) After a predetermined time (time required for the potential of the transfer signal CK1 to rise to nearly "L" (−3.3 V)) has elapsed (at a time point d), the three-state buffer B1R is set from the high impedance (Hiz) to "L." In response, a current starts flowing in the resistor R1B of the level shift circuit 104. Meanwhile, the current flowing in the capacitor C1 of the level shift circuit 104 gradually decreases since the potential of the transfer signal CK1 rises.

When the transfer thyristor T1 is turned on to be a steady state, current for keeping the transfer thyristor T1 turned on flows therein via the transfer current limiting resistor R1A and the resistor R1B of the level shift circuit 104.

In addition, when the transfer thyristor T1 gets turned on, the potential of the signal line Φ1 becomes approximately −1.5 V, and thus the potential of the gate terminal G1 becomes approximately "H" (0 V).

(5) At a time point e, the light-emission signal ID is set to "Le." Here, the time point e is a time point after the transfer thyristor T1 gets completely turned on and the light-emitting period tc1 before the time point f when the light-emitting thyristor L1 stops emitting light. The light-emitting period tc1 is a period set for the light-emitting thyristor L1.

At the time point e, the potential of the gate terminal G1 of the light-emitting thyristor L1 is set to 0 V. Thus, according to the aforementioned conditions for turning on a thyristor, the light-emitting thyristor L1 starts emitting light if a voltage lower than −1.5 V is applied to the cathode terminal of the light-emitting thyristor L1 (to the light-emission signal line ΦI).

Meanwhile, as is clear from FIG. 5, the potential of the gate terminal G2 of the light-emitting thyristor L2 is made −1.5 V by the forward-biased diode D1. Thus, the light-emitting thyristor L2 starts emitting light when a voltage lower than −3.0 V is applied to the cathode terminal of the light-emitting thyristor L2 (to the light-emission signal line ΦI). Similarly, the light-emitting thyristor L3 starts emitting light when a voltage lower than −4.5 V is applied to its cathode terminal (to the light-emission signal line ΦI) since the potential of the gate terminal G3 is −3.0 V. Moreover, each of the light-emitting thyristors L4, L5, . . . , starts emitting light when a voltage lower than −4.8 V is applied to its cathode terminal (to the light-emission signal line ΦI) since the potential of its gate terminal is the power supply voltage Vga of −3.3 V.

Hence, if the light-emission signal ID is set to a value that causes the light-emission signal line ΦI to have a potential lower than −1.5 V and higher than −3.0 V, only the light-emitting thyristor L1 is allowed to be turned on and to emit light. Here, the potential of the light-emission signal line ΦI lower than −1.5 V and higher than −3.0 V is referred to as light-emission potential Le, and the level thereof is indicated by "Le" in the timing charts.

(6) Then, at the time point f, the light-emission signal ID is set to "H." This causes the cathode terminal and the anode terminal of the light-emitting thyristor L1 to have approximately the same potential. Accordingly, the light-emitting thyristor L1 is no longer kept turned on, and thus stops emitting light. However, the transfer thyristor T1 is kept turned on.

(7) In addition, at the same time point f, the transfer signal CK2R is set to "L." In response, the transfer signal CK2 changes from "H" to "L," and thus a voltage is generated between the terminals of the capacitor C2 of the level shift circuit 104.

At the time point f, the potential of the gate terminal G1 is set to approximately 0 V, and thus the potential of the gate terminal G2 is set to −1.5 V. Thus, when the potential of the signal line Φ2 becomes lower than −3 V, a gate current starts flowing in the transfer thyristor T2, and thus the transfer thyristor T2 starts being turned on.

(8) Then, at a time point g, the transfer signal CK2C is set to "L." In response, the potential of the transfer signal CK2 sharply drops to −6.6 V. This accelerates the pace for turning on the transfer thyristor T2. Note that the transfer thyristors T1 and T2 are both turned on at the time point g.

(9) Subsequently, at a time point h, the transfer signals CK1C and CK1R are both set to "H." This causes the anode terminal and the cathode terminal of the transfer thyristor T1 to have approximately the same potential, and thus turns off the transfer thyristor T1.

After the transfer thyristor T1 gets turned off, a current flows through the resistor R1. This causes the potential of the gate terminal G1, which has been set to approximately 0 V, to gradually drop to the power supply voltage Vga (−3.3 V).

Meanwhile, the transfer thyristor T2 is turned on at the time point h.

(10) Thereafter, at a time point i, the light-emission signal ID is set to a value so that the potential of the light-emission signal line ΦI is the light-emission potential Le. As a result, the light-emitting thyristor L2 starts emitting light. Here, the time point i is a time point the light-emitting period tc2 before the time point j when the light-emitting thyristor L2 stops emitting light. The light-emitting period tc2 is a period set for the light-emitting thyristor L2.

When the transfer thyristor T2 is turned on, the potential of the gate terminal G2 rises to 0 V. However, the effect of this potential rise is not transmitted to the gate terminal G1 since the diode D1 is reverse biased. Accordingly, at the time point i, the potential of the gate terminal G1 remains −3.3 V of Vga. Thus, the potential of the light-emission signal line ΦI needs to be lower than −4.8 V in order to cause the light-emitting thyristor L1 to emit light. Hence, at the time point i, the light-emitting thyristor L1 has no chance of getting turned on as long as the potential of the light-emission signal line ΦI is set to the light-emission potential Le as described above. In other words, at the time point i, only the light-emitting thyristor L2 is allowed to emit light.

(11) By sequentially repeating the above operations ((2) to (10)), the light-emitting thyristors L3 to L128 may be sequentially caused to emit light in numerical order.

In the example shown in FIG. 8, all the light-emitting thyristors L1 to L4 are caused to emit light. However, the light-emitting thyristors L1 to L128 are controllable so as to emit light or not on a single light-emitting thyristor basis. Specifically, based on image data, each light-emitting thyristor may be set to "emit light" by setting the light-emission signal ID to "Le", or may be set to "not emit light" by maintaining the light-emission signal ID at "H".

In addition, by changing the time point when each light-emitting thyristor starts emitting light, that is, the time point when the light-emission signal ID is changed from "H" to "Le," the light-emitting period tc for the light-emitting thyristor is adjustable in length, and thus the luminous amount of the light-emitting thyristor is correctable on a single light-emitting thyristor basis.

As described above, in the present exemplary embodiment, when multiple transfer thyristors, which are consecutively connected with diodes interposed therebetween, are sequentially turned on, a light-emitting thyristor corresponding to the transfer thyristor that is currently turned on is set ready to emit light by raising the potential of the gate terminal of the light-emitting thyristor. On the other hand, when a transfer thyristor is made to be turned off, a light-emitting thyristor corresponding to the transfer thyristor is set unready to emit light.

Assume here that three of the transfer thyristors, which are consecutively connected with diodes interposed therebetween, are turned off, and focus on the middle one of the three transfer thyristors. Then, among the three transfer thyristors, the most upstream transfer thyristor and the middle transfer thyristor get turned on in this order, so that both of them are turned on. Next, the most upstream transfer thyristor gets turned off, so that only the middle transfer thyristor is turned on. Then, the most downstream transfer thyristor gets turned on, so that the most downstream transfer thyristor and the middle transfer thyristor are both turned on. Lastly, the middle transfer thyristor gets turned off. In this way, the turned-on state of the transfer thyristors is propagated (transmitted).

Next, the light-emitting periods tc will be described in more detail. Variations in properties of the light-emitting thyristors and the like might cause density irregularity in an image to be formed. Thus, in order to reduce density irregularity in an image to be formed, and thus to improve quality of the image, luminous amount of the light-emitting thyristors are corrected based on previously measured data on a single light-emitting thyristor basis.

In the present exemplary embodiment, luminous amount of the light-emitting thyristors is corrected by employing the variable light-emitting periods tc. For example, in the period T(L3) of FIG. 8, the light-emitting thyristor L3 is caused to emit light by setting the light-emission signal ID to "Le" during the light-emitting period tc3 from the time point n to the time point p. In this way, the light-emitting periods tc are individually set for the respective light-emitting thyristors. More specifically, in the present exemplary embodiment, the light-emitting period tc of each light-emitting thyristor is adjusted to correct its luminous amount by causing the light-emitting thyristor to stop emitting light at a fixed timing (at the time point p in the period T(L3)) and to start emitting light at variable timing (at the time point n in the period T(L3)).

Here, a description will be given of the light-emission ready period te by using the period T(L3) as an example. The light-emitting period tc3 is allowed to be set within the light-emission ready period te.

In FIG. 8, the transfer signals CK1R and CK2R are both set to "L" during the period ta from the time point j to the time point l, as described above. This period ta is a period when the transfer thyristor T2 upstream and adjacent to the transfer thyristor T3 is turned on and when the transfer thyristor T3 is switched to the turned-on state. Therefore, in this period, the potential of the gate terminal G2 of the transfer thyristor T2 is 0 V, while the potential of the gate terminal G3 of the transfer thyristor T3 changes toward 0 V. Then the threshold voltage of the light-emitting thyristor L2 is kept at −1.5 V, while the threshold voltage of the light-emitting thyristor L3 changes from −3.0 V to −1.5 V. Thus, if the light-emission signal line ΦI is caused to have the light-emission potential Le in the period ta, not only the light-emitting thyristor L3 but also the light-emitting thyristor L2, which is not intended to emit light, might emit light.

In the period ta of the period T(L3), besides the turned-on transfer thyristor T2, the transfer thyristor T3 downstream and adjacent to the transfer thyristor T2 is switched to the turned-on state by setting both of the transfer signals CK1R and CK2R to "L." Thus, the period ta corresponds to a period during which the transfer signals to turn on both of the two adjacently connected transfer thyristors are supplied.

Then, at the time point l in FIG. 8, the transfer signals CK2C and CK2R are both set to "H." This causes the anode terminal and the cathode terminal of the transfer thyristor T2, which is upstream and adjacent to the transfer thyristor T3, to have approximately the same potential, and thus turns off the transfer thyristor T2. As a result, a current flows through the resistor R2, and thus the potential of the gate terminal G2, which has been approximately 0 V, changes to the power supply voltage Vga of −3.3 V.

However, if the light-emission signal line ΦI were caused to have the light-emission potential Le with the potential of the gate terminal G2 still remaining equal to or near 0 V, not only the light-emitting thyristor L3 but also the light-emitting thyristor L2, which is not intended to emit light, would emit light, like the above.

In other words, the period tb is a period until the light-emitting thyristor L2 becomes disabled to emit light due to the transition of the potential of the gate terminal G2 toward the power supply voltage Vga of −3.3 V even if the light-emission signal line ΦI is caused to have the light-emission potential Le.

Hence, the light-emission ready period te during which only the light-emitting thyristor L3 is ready to emit light may be set to a period from the end point of the period tb in the period T(L3) to the start point of the period ta in the period T(L4). Therefore, the light-emission ready period te may be expressed as te=T−ta−tb.

In addition, in the present exemplary embodiment, the time point when each light-emitting thyristor starts emitting light, that is, the time point of switching the light-emission signal ID from "H" to "Le," is set to a time point that is after the end point of the period tb, and that is the light-emitting period tc before the start point of the next period ta. Here, the end point of the light-emitting period tc is set to the start point of the period ta.

Note that the time point when each light-emitting thyristor starts emitting light may be calculated by the drive circuit 100 from image data and the luminous amount correction value for the light-emitting thyristor, and may be set up by using a pulse generating circuit.

Note that in the present exemplary embodiment, the end point of the light-emitting period tc is set to the start point of the period ta during which the transfer signals to turn on both of the two of the adjacently connected transfer thyristors are supplied. However, the end point of the light-emitting period tc may be set a predetermined period before the start point of the period ta. The reason is as follows. Suppose that a transfer thyristor is unexpectedly turned off and that the potential of the gate terminal thereof starts to be switched to "L." Even in this case, as will be described later, a transfer error will not occur, if the transfer signals for turning on the downstream transfer thyristor are supplied while the downstream transfer thyristor is allowed to be turned on.

A period that is allowed to be taken as the predetermined period before the start point of the period ta corresponds to one that is from the following start point to the following end point, and during which the downstream transfer thyristor is allowed to be turned on. Here, the start point is when the transfer signals that turn off the upstream transfer thyristor without turning on the downstream transfer thyristor are supplied (for example, the transfer signals CK1R and CK1C are switched from "L" to "H"). The end point is when the transfer signals to turn on the downstream transfer thyristor are supplied (for example, the transfer signal CK2R is switched from "H" to "L"). This is because a transfer thyristor does not get turned off at once even if the transfer signals to turn off the transfer thyristor are supplied, and thus the downstream transfer thyristor may be switched to the turned-on state even after a while. Note that the predetermined period before the start point of the period ta does not need to be the maximum period during which the downstream transfer thyristor is allowed to be turned on, and a shorter period than the maximum period may be used.

Moreover, the end point of the light-emitting period tc may be set a predetermined period after the start point of the period ta. The reason is as follows. As described above, since the period ta is a period when the downstream transfer thyristor is caused to be turned on, the downstream transfer thyristor does not get turned on for a while after the start point of the period ta. Thus the threshold voltage of the light-emitting thyristor connected to the downstream transfer thyristor does not rise enough. Accordingly, the light-emitting thyristor is not allowed to get turned on even if the light-emission potential Le is provided. In this case, the predetermined period after the start point of the period ta does not need to be the maximum period, and a shorter period than the maximum period may be used.

EXAMPLE

Figure 9:
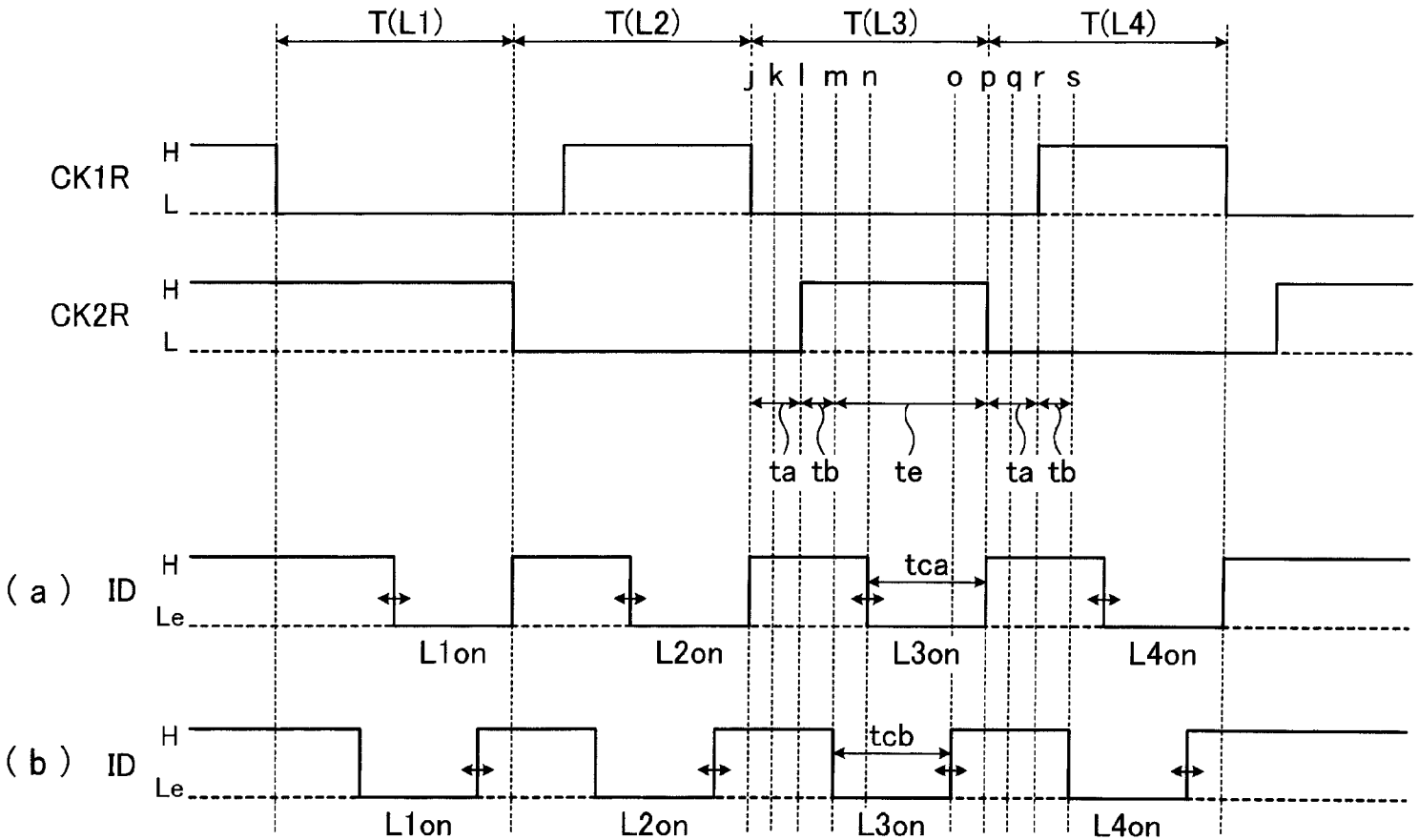
FIG. 9 is a timing chart showing experimental conditions employed for an example of the present exemplary embodiment and a comparative example.

FIG. 9 is a timing chart showing experimental conditions employed for an example of the present exemplary embodiment and a comparative example. Among the signals shown in FIG. 8, FIG. 9 focuses on the transfer signal CK1R and CK2R, and the light-emission signal ID. The experimental conditions will be described by using, as an example, the period T(L3) in which the light-emitting thyristor L3 is allowed to emit light.

In the example of the present exemplary embodiment indicated by (a) in FIG. 9, each transfer thyristor starts emitting light at a time point (the time point n, for example) that is a predetermined light-emitting period tc (tca) before the start point of a period ta (the time point p, for example), and stops emitting light at the start point of the period ta (the time point p, for example). Note that, during each period ta, the transfer signals to turn on both of the adjacent two transfer thyristors are supplied. The light-emitting period tc (tca) is changed in length by varying the timing when the transfer thyristor starts emitting light.

On the other hand, in the comparative example indicated by (b) in FIG. 9, each transfer thyristor starts emitting light at a time point (the time point m, for example) when a period ta (from the time point j to the time point l, for example) and a period tb (from the time point l to a time point m, for example) have elapsed, and stops emitting light at a time point (a time point o, for example) when a predetermined light-emitting period to (tcb) have elapsed. Note that, during each period ta, the transfer signals to turn on both of the adjacent two transfer thyristors are supplied, and the subsequent period tb is taken for the light-emitting thyristor connected to the upstream one of the two transfer thyristors to become disabled to emit light. The light-emitting period tc (tcb) is changed in length by varying the timing when the transfer thyristor stops emitting light (at the time point o, for example).

Note that the light-emitting periods tc in the example and the comparative example are referred to as light-emitting periods tca and tcb, respectively, so as to be distinguished from each other.

The lengths of the light-emission control period T for each light-emitting thyristor, the period ta and the period tb are set to 460 ns, 20 ns and 40 ns, respectively. The power supply voltage Vga terminal is set to 0 V, and a positive voltage is applied to the reference potential Vsub terminal. These voltage settings are different from those described above. However, the voltage settings here employ values only shifted from those described above, and thus are the same in the relative level relation between the power supply voltage Vga and the reference potential Vsub.

Under these conditions, the transfer operations of the transfer thyristors are observed by changing the voltage (power supply voltage) between the reference potential Vsub terminal and the reference potential Vga terminal, and the length of the light-emitting period tc (tca or tcb). The minimum power supply voltage that allows the transfer thyristors to normally perform the transfer operations is employed as operating voltage.

The experiment is conducted on three different SLED chips.

Figure 10:
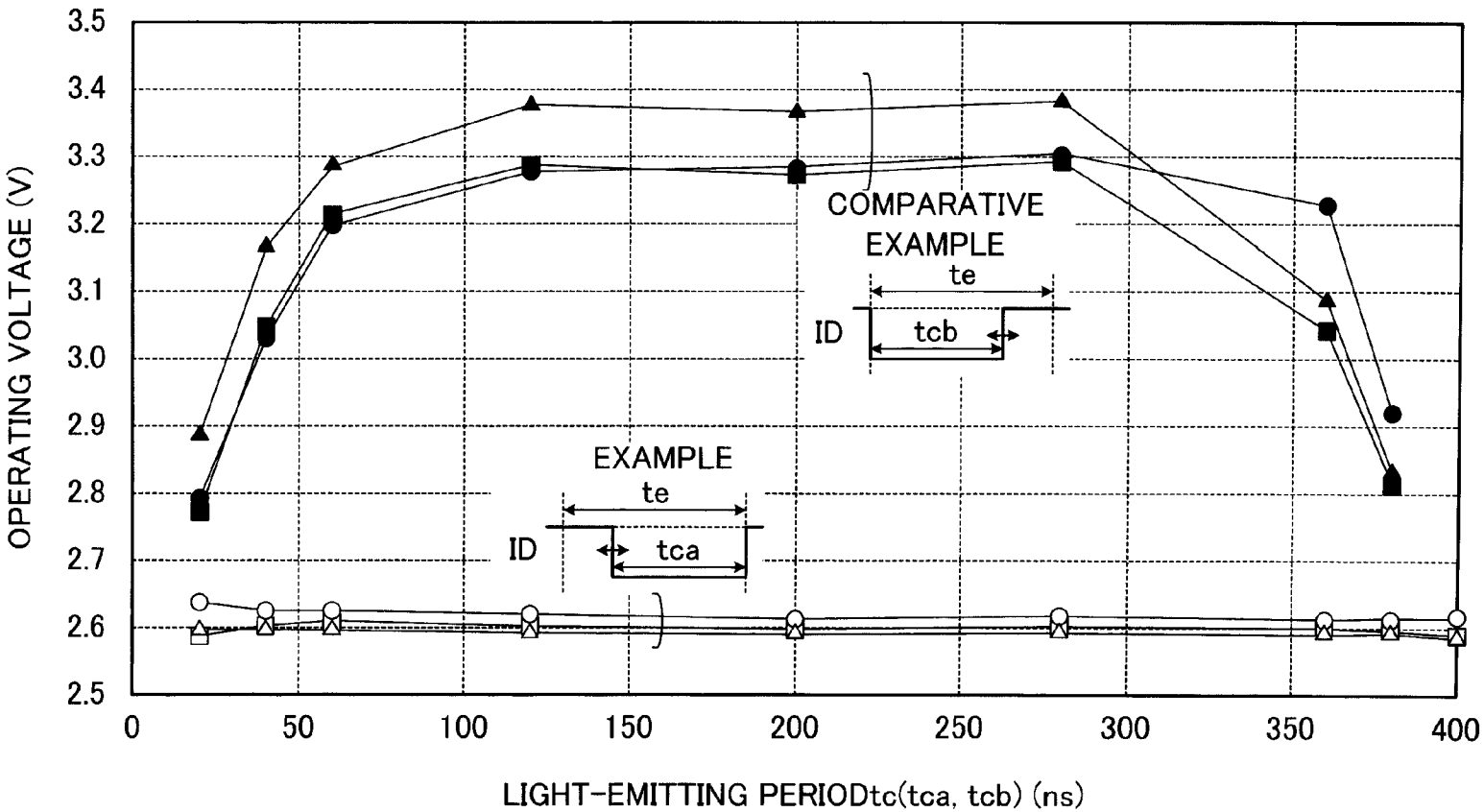
FIG. 10 is a graph showing experimental results of the example and the comparative example.

FIG. 10 is a graph showing experimental results of the example and the comparative example. The horizontal axis is the light-emitting period tca or tcb, and the vertical axis is the operating voltage. In FIG. 10, the values indicated by ○, Δ and □ correspond to experimental results of the example on the three different SLED chips, respectively. Meanwhile, the values indicated by •, ▲ and ■ correspond to experimental results of the comparative example on the three different SLED chips, respectively. Note that the pair of ○ and •, the pair of Δ and ▲, and the pair of □ and ■ each indicate experimental results on the same SLED chip.

FIG. 10 shows the following results. In the example, the operating voltage is maintained substantially 2.6 V irrespective of the length of light-emitting period tca. By contrast, in the comparative example, the operating voltage is around 2.8 V when the light-emitting period tcb is short, e.g. 20 ns, and when the light-emitting period tcb is long, e.g. 380 ns. However, the operating voltage in the comparative example is high, e.g. 3 V or higher when the length of the light-emitting period tcb takes the other values. Specifically, the operating voltage in the comparative example is up to 0.7 V higher than that in the example. As the experimental results show, the present exemplary embodiment allows the drive voltage to be set low irrespective of the length of the light-emitting period.

The reason why the operating voltage in the comparative example is higher than that in the example is considered to be attributable to a transfer error.

While the SLED chips are driven, a phenomenon sometimes occurs in which the turned-on transfer thyristor gets turned off at timing other than the proper timing for the transfer thyristor to get turned off. Once the transfer thyristor accidentally gets turned off, the transfer operation might need to start again from the first light-emitting thyristor, for example. As typified by this example, the phenomenon leads to a failure of the normal transfer operation, and thus a failure of providing a proper image. The failure of the normal transfer is called as "transfer error."

Hereinafter, the transfer error will be described.

Figure 11:
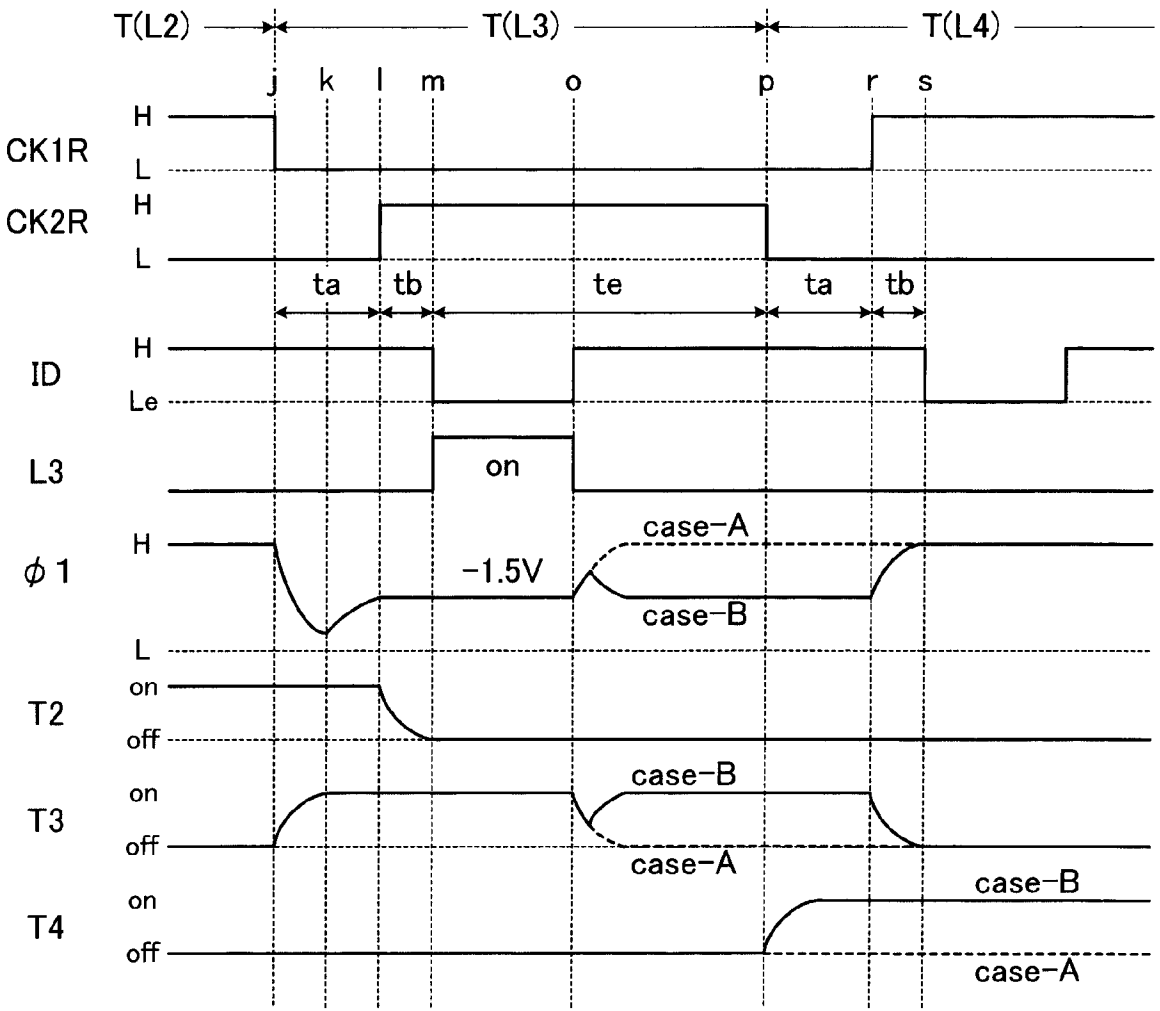
FIG. 11 is a timing chart for illustrating the transfer error in the SLED.

FIG. 11 is a timing chart for illustrating the transfer error in the SLED 63.

Among the signals and the periods shown in FIG. 8, FIG. 11 focuses on the transfer signals CK1R and CK2R, and the light-emission signal ID in a period, centering on the period T(L3), from the time point j to a time point s. In addition, FIG. 11 also shows the states of turned-on and turned-off of the light-emitting thyristor L3 and the transfer thyristors T2, T3 and T4. Note that, in the description, it is assumed that the power supply voltage Vga is −3.3 V, and that the reference potential Vsub is 0 V.

At the time point j, the transfer signal CK1R is switched from "H" (0 V) to "L" (−3.3 V). This causes a current to start flowing through the gate terminal G3 in the transfer thyristor T3, and thus the transfer thyristor T3 starts being turned on.

Then, when the transfer thyristor T3 gets turned on, the potential of the signal line Φ1 changes to approximately −1.5 V (at the time point l).

After that, at the time point m, the light-emission signal ID is switched from "H" to "Le." As a result, the light-emitting thyristor L3 gets turned on to emit light.

Then, at the time point o when the transfer thyristor T3 is turned on, the light-emission signal ID is set to "H," and thus the light-emitting thyristor L3 gets turned off. This causes the potential of the signal line Φ1 to rise toward "H," and sometimes to remain at "H" as in the case-A indicated by the dashed line in FIG. 11. When the signal line Φ1 reaches "H," the transfer thyristor T3 is no longer kept turned on, and thus gets turned off. In response, the potential of the gate terminal G3 changes from approximately 0 V to the power supply voltage Vga of −3.3 V. Accordingly, the potential of the gate terminal G4 becomes the power supply voltage Vga of −3.3 V, too.

As a result, even though the transfer signal CK2R is set to "L" (−3.3 V) at the time point p, the transfer thyristor T4 does not get turned on, thus remaining turned off. In other words, the turned-on state does not transfer from the transfer thyristor T3 to the transfer thyristor T4, so that the transfer operation is interrupted.

Meanwhile, the potential of the signal line Φ1 that starts rising toward "H" (0 V) at the time point o might sometimes drop again, and thus return to the pre-rise potential as in the case-B indicated by the solid line in FIG. 11. In this case, the transfer operation is performed normally since the transfer thyristor T4 is allowed to be turned on as long as the transfer thyristor T3 is turned on at the time point p.

Next, a description will be given of the reason why the potential of the signal line Φ1 changes as the light-emission signal ID changes.

Figure 12:
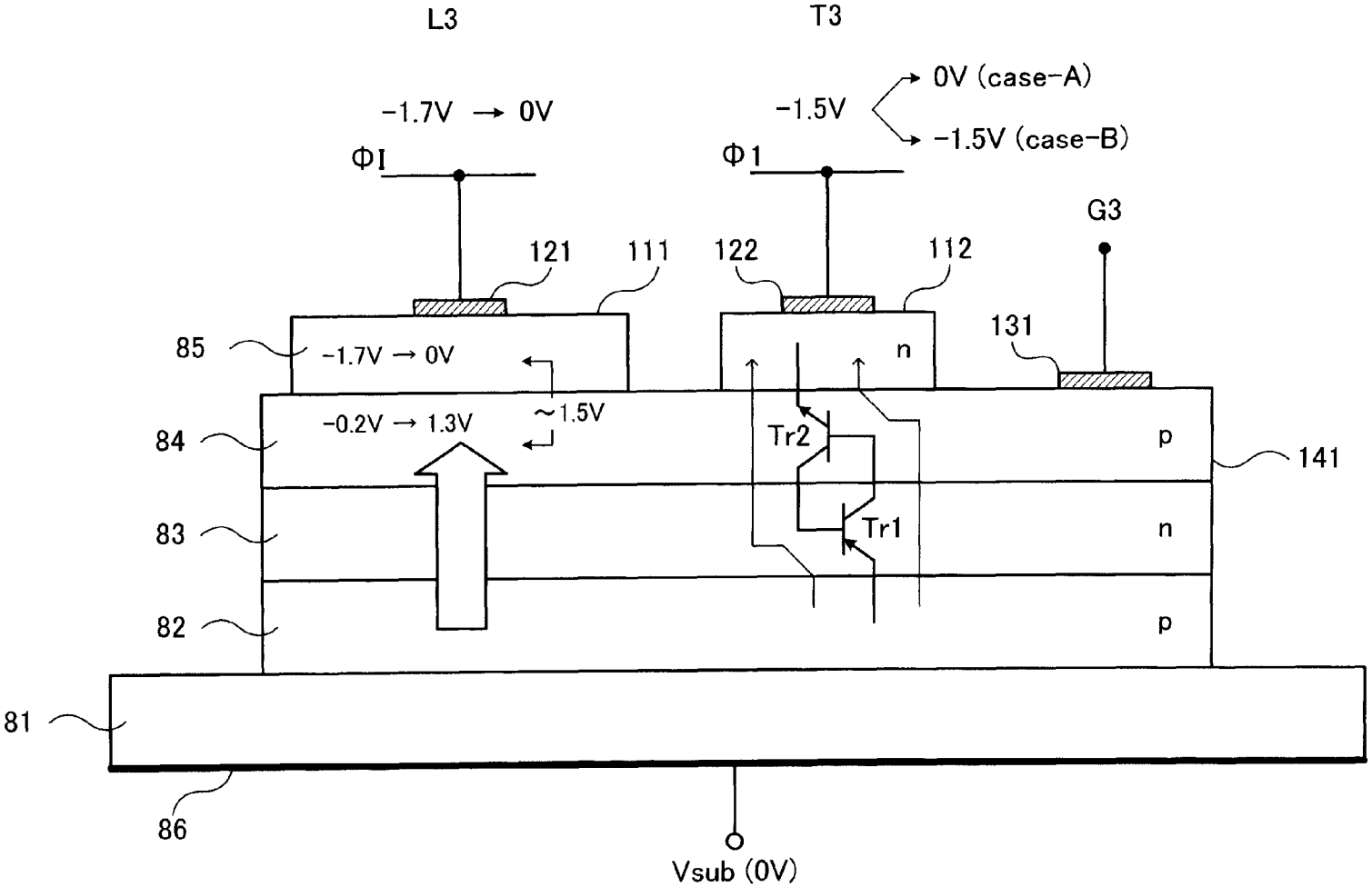
FIG. 12 is a cross-sectional view of the light-emitting thyristor and the transfer thyristor for explaining the transfer error.

FIG. 12 is a cross-sectional view of the light-emitting thyristor L3 and the transfer thyristor T3 for explaining the transfer error (The cross-sectional view is taken along the VIIB-VIIB line of FIG. 7A). As shown in FIG. 7A, the light-emitting thyristor L3 and the transfer thyristor T3 are formed in a single island.

Note that FIG. 12 also shows the equivalent circuit formed of the npn transistor Tr1 and the pnp transistor Tr2 in the transfer thyristor T3.

Here, the period from the time point m to the time point p in FIG. 11 will be reviewed.

Suppose that a voltage of −1.7 V is supplied to the light-emission signal line ΦI at the time point m. The voltage of −1.7 V is the aforementioned light-emission potential Le, and thus is capable of causing only the light-emitting thyristor L3 to emit light.

In this case, the n-type fourth semiconductor layer 85 in the region 111 that is connected to the light-emission signal line ΦI through the ohmic electrode 121 (through the cathode terminal of the light-emitting thyristor L3) has a potential of −1.7 V.

In a turned-on thyristor, the potential difference between the cathode terminal and the gate terminal is approximately equal to Vd (1.5 V), as described above. Accordingly, the p-type third semiconductor layer 84 that is connected to the gate terminal G3 of the light-emitting thyristor L3 has a potential of −0.2 V.

This is equivalent to the condition where a storage capacitor capable of storing a potential difference 1.5 V is formed between the ohmic electrode 121 and the gate terminal G3.

Then, at the time point o, the potential of the light-emission signal line ΦI is raised from −1.7 V to 0 V to turn off the light-emitting thyristor L3. This causes the potential of the p-type third semiconductor layer 84 to sharply shift from −0.2 V to 1.3 V so as to maintain the potential difference at 1.5 V.

In response, the potential of the signal line Φ1 rises toward "H" (0 V) (corresponding to the change in the signal line Φ1 at the time point o in FIG. 11). This is because the p-type third semiconductor layer 84 is shared by the light-emitting thyristor L3 and the transfer thyristor T3, and is not separated therebetween.

In this case, if the drive circuit 100 is capable of supplying the signal line Φ1 with a sufficient current, the effect of the potential rise of the signal line Φ1 is canceled out, and the potential of the signal line Φ1 returns to the pre-rise value (the case-B).

However, in the present exemplary embodiment, the signal line Φ1 is connected to the drive circuit 100 via the transfer current limiting resistor R1A and the resistor R1B. Accordingly, the drive circuit 100 is considered to be incapable of supplying a current large enough to cancel out the effect of the sharp potential rise of the signal line Φ1, and thus has difficulty in maintaining the potential of the signal line Φ1 at −1.5 V.

As a result, the potential of the collector terminal (the p-type third semiconductor layer 84) of the pnp transistor Tr1 constituting the transfer thyristor T3 rises. Accordingly, the potential relation between the collector terminal and the emitter terminal of the pnp transistor Tr1 is reversed, and thus the pnp transistor Tr1 gets turned off. Therefore, it is considered that the transfer thyristor T3 gets turned off (the case-A), and thus the transfer operation is interrupted (transfer error occurs) in this case.

The above description allows the following presumption. It is because the drive circuit 100 needs to have a larger current supply capability in order to realize the case-B that the operating voltage in the comparative example is higher as shown in FIG. 10.

Hence, the transfer error is frequently observed especially when the transfer thyristors are driven with a low power supply voltage. The transfer error will less frequently occur by increasing a current (holding current) or a voltage (holding voltage) for keeping the turned-on state of each transfer thyristor. However, in a light-emitting element array drive device formed with a large number of SLED chips arrayed on a printed circuit board, the drive circuit needs to have increased current supply capability for driving the transfer thyristors. This increases the size of the drive circuit, and thus increases the size of the light-emitting element array drive device. In addition, this further leads to increase in heat generation and light leakage from the SLED chips.

As described above, the transfer error is considered to occur when the light-emission signal ID is caused to shift from "Le" to "H" so as to turn off the light-emitting thyristor L3 in the period during which the transfer thyristor T3 is turned on. In another respect, the transfer error is considered to occur when the transfer thyristor T4 downstream and adjacent to the transfer thyristor T3 is disabled from getting turned on by the transfer thyristor T3 accidentally getting turned off.

Thus, as shown in the example of the present exemplary embodiment, the transfer error is made unlikely to occur if the light-emitting thyristor L3 gets turned off at the timing when the transfer thyristor T4 downstream and adjacent to the transfer thyristor T3 gets turned on. That is, even if the transfer thyristor T3 gets turned off at timing when the light-emission signal ID changes from "Le" to "H," the potential of the gate terminal G3 will not sharply drop from 0 V to −3.3 V. Accordingly, the potential of the gate terminal G4, which is connected to the gate terminal G3 via the diode D3 will not sharply drop from −1.5 V to −3.3 V. Therefore, it is considered that the transfer thyristor T4 gets turned on upon transition of the transfer signal CK2R from "H" to "L," and thus the transfer operations are normally performed.

Note that the reason why the operating voltage is low when the light-emitting period tcb is short in the comparative example is considered as follows. Even after the period tb has elapsed, the potential of the gate terminal G2 of the transfer thyristor T2 that has been turned on does not drop to −3.3 V. Accordingly, even if the transfer thyristor T3 may be temporally about to get turned off, the transfer thyristor T3 is likely to be turned on again.

Meanwhile, the reason why the operating voltage is low when the light-emitting period tcb is long in the comparative example is considered as follows. Like in the example, even if the transfer thyristor T3 gets turned off, the potential of the gate terminal G3 does not drop from 0 V to −3.3 V. Accordingly, the potential of the gate terminal G4 remains around −1.5 V, which allows the transfer thyristor T4 to get turned on.

Note that, in the example, the time point when the light-emitting thyristor stops emitting light is set to the start point (the time point when the transfer signals CK1R and CK2R are both set to "L") of the period ta during which the transfer signals to turn on both two transfer thyristors are supplied. However, the time point when the light-emitting thyristor stops emitting light needs not necessarily to be set to the start point of the period ta.

For example, as shown in FIG. 10, the operating voltage is as low as 2.8 V when the length of the light-emitting period tc is 380 ns in the comparative example. Thus, the time point when the light-emitting thyristor stops emitting light may be set to a time point within at most 20 ns before the start point of the period ta.

Note that this period corresponds to the period that is after the transfer signals turning off the upstream transfer thyristor are supplied, and during which the turned-off downstream transfer thyristor is allowed to be turned on, as described above. Accordingly, the end point of the light-emitting period tc may be set the period determined as described above before the start point of the period ta during which the transfer signals to turn on both two transfer thyristors are supplied.

Note that, although the pace for turning on the transfer thyristor is accelerated by using the level shift circuit 104 in the present exemplary embodiment, the level shift circuit 104 need not necessarily be used.

Moreover, in the present exemplary embodiment, a description has been given of the case where each of the light-emitting thyristors and the transfer thyristors is a three-terminal thyristor whose anode terminal has the reference potential Vsub. However, if polarities of the circuit are changed, an alternative case may be employed. Specifically, each of the light-emitting thyristors and the transfer thyristors may be a three-terminal thyristor whose cathode terminal has the reference potential Vsub.

In the present exemplary embodiment, the SLED 63 is formed of a GaAs-based semiconductor, but the material of the SLED 63 is not limited to this. For example, the SLED 63 may be formed of another composite semiconductor, such as GaP, difficult to turn into a p-type semiconductor or an n-type semiconductor by ion implantation.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A light-emitting element array drive device, comprising:

a plurality of light-emitting elements;

a plurality of switch elements that are electrically connected respectively to the plurality of light-emitting elements and that are electrically connected mutually in an array, each of the switch elements, when turned on, setting one of the light-emitting elements connected thereto ready to emit light, and, when turned off, setting the one of the light-emitting elements connected thereto unready to emit light;

a transfer signal supply unit that supplies transfer signals for propagating a turned-on state among the plurality of switch elements by sequentially switching each of the switch elements from a turned-off state to the turned-on state, and to the turned-off state, the transfer signals having periods during each of which one of the switch elements is turned on, the periods being displaced so that each two of the periods for two of the switch elements adjacently-connected have an overlapping period, the two of the switch elements being both turned on during the overlapping period; and a light-emission signal supply unit that supplies a light-emission signal having light-emitting periods during each of which one of the light-emitting elements is turned on, each of the light-emitting periods having an end point set based on a start point of the overlapping period during which the transfer signals start to turn on both of the two of the switch elements adjacently-connected are supplied, and each of the light-emitting periods having a start point set to a time point before the end point.

2. The light-emitting element array drive device according to claim 1, wherein the start point of each of the light-emitting periods is after an end point of the overlapping period during which one of the switch elements provided corresponding to one of the light-emitting elements and upstream one of the switch elements electrically connected to the one of the switch elements are both turned on, and after an end point of a period during which one of the light-emitting elements corresponding to the upstream one of the switch elements is set ready to emit light.

3. The light-emitting element array drive device according to claim 1, wherein the end point of each of the light-emitting periods is set to a time point before the start point of the overlapping period during which the transfer signals to turn on both of the two of the switch elements adjacently-connected are supplied, after the transfer signals that switch upstream one of the two of the switch elements adjacently-connected to the turned-off state are supplied, and in a period during which downstream one of the two of the switch elements adjacently-connected may be switched to the turned-on state, the downstream one being in the turned-off state.

4. The light-emitting element array drive device according to claim 1, wherein the end point of each of the light-emitting periods is set within 20 ns before the start point of the overlapping period during which the transfer signals to turn on both one of the switch elements provided corresponding to one of the light-emitting elements and downstream one of the switch elements electrically connected to the one of the switch elements are supplied.

5. The light-emitting element array drive device according to claim 1, wherein the end point of each of the light-emitting periods is set to a time point after the start point of the overlapping period during which the transfer signals to turn on both of the two of the switch elements adjacently-connected are supplied, and before an end point of a period during which one of the light-emitting elements connected to downstream one of the two of the switch elements adjacently-connected is kept unready to emit light.

6. The light-emitting element array drive device according to claim 1, wherein the start point of each of the light-emitting periods is set for each of the light-emitting elements.

7. The light-emitting element array drive device according to claim 1, wherein the transfer signal supply unit includes a level shift unit.

8. The light-emitting element array drive device according to claim 7, wherein the level shift unit has one end terminal connected to one of the switch elements, and another end terminal branched in parallel to a signal line connected to a capacitor and a signal line connected to a resistor.

9. The light-emitting element array drive device according to claim 1, wherein each of the light-emitting elements and the switch elements is formed of a thyristor.

10. A print head comprising:

an exposure unit that exposes an image carrier; and an optical unit that focuses light emitted by the exposure unit onto the image carrier, the exposure unit including:

a light-emitting device that includes a plurality of light-emitting elements, and a plurality of switch elements that are electrically connected respectively to the plurality of light-emitting elements and that are electrically connected mutually in an array, each of the switch elements, when turned on, setting one of the light-emitting elements connected thereto ready to emit light, and, when turned off, setting the one of the light-emitting elements connected thereto unready to emit light;

a transfer signal supply unit that supplies transfer signals for propagating a turned-on state among the plurality of switch elements by sequentially switching each of the switch elements from a turned-off state to the turned-on state, and to the turned-off state, the transfer signals having periods during each of which one of the switch elements is turned on, the periods being displaced so that each two of the periods for two of the switch elements adjacently-connected have an overlapping period, the two of the switch elements being both turned on during the overlapping period; and a light-emission signal supply unit that supplies a light-emission signal having light-emitting periods during each of which one of the light-emitting elements is turned on, each of the light-emitting periods having an end point set based on a start point of the overlapping period during which the transfer signals start to turn on both of the two of the switch elements adjacently-connected are supplied, and each of the light-emitting periods having a start point set to a time point before the end point.

11. The print head according to claim 10 including a plurality of the light-emitting devices.

12. An image forming apparatus comprising:

an exposure unit that exposes an image carrier so as to form an electrostatic latent image thereon;

an optical unit that focuses light emitted by the exposure unit onto the image carrier;

a developing unit that develops the electrostatic latent image formed on the image carrier, and a transfer unit that transfers an image developed on the image carrier onto a transferred body, the exposure unit including:

a charging unit that charges the image carrier;

a plurality of light-emitting devices each of which includes a plurality of light-emitting elements, and a plurality of switch elements that are electrically connected respectively to the plurality of light-emitting elements and that are electrically connected mutually in an array, each of the switch elements, when turned on, setting one of the light-emitting elements connected thereto ready to emit light, and, when turned off, setting the one of the light-emitting elements connected thereto unready to emit light;

a transfer signal supply unit that supplies transfer signals for propagating a turned-on state among the plurality of switch elements by sequentially switching each of the switch elements from a turned-off state to the turned-on state, and to the turned-off state, the transfer signals having periods during each of which one of the switch elements is turned on, the periods being displaced so that each two of the periods for two of the switch elements adjacently-connected have an overlapping period, the two of the switch elements being both turned on during the overlapping period; and a light-emission signal supply unit that supplies a light-emission signal having light-emitting periods during each of which one of the light-emitting elements is turned on, each of the light-emitting periods having an end point set based on a start point of the overlapping period during which the transfer signals start to turn on both of the two of the switch elements adjacently-connected are supplied, and each of the light-emitting periods having a start point set to a time point before the end point.

13. A signal supplying method for a light-emitting element array drive device including a plurality of light-emitting elements, and a plurality of switch elements that are electrically connected respectively to the plurality of light-emitting elements and that are electrically connected mutually in an array, each of the switch elements, when turned on, setting one of the light-emitting elements connected thereto ready to emit light, and, when turned off, setting the one of the light-emitting elements connected thereto unready to emit light; the signal supplying method comprising:

supplying transfer signals for propagating a turned-on state among the plurality of switch elements by sequentially switching each of the switch elements from a turned-off state to the turned-on state, and to the turned-off state, the transfer signals having periods during each of which one of the switch elements is turned on, the periods being displaced so that each two of the periods for two of the switch elements adjacently-connected have an overlapping period, the two of the switch elements being both turned on during the overlapping period; and supplying a light-emission signal having light-emitting periods during each of which one of the light-emitting elements is turned on, each of the light-emitting periods having an end point set based on a start point of the overlapping period during which the transfer signals start to turn on both of the two of the switch elements adjacently-connected are supplied, and each of the light-emitting periods having a start point set to a time point before the end point.

* * * * *